US006244340B1

(12) United States Patent
McGlothen et al.

(10) Patent No.: US 6,244,340 B1
(45) **Date of Patent: *Jun. 12, 2001**

(54) SELF-LOCATING REENTRY SYSTEM FOR DOWNHOLE WELL COMPLETIONS

(75) Inventors: Jody R. McGlothen, Waxahachie, TX (US); Daniel J. Themig, Cochrane (CA); Robert T. Brooks, Houston, TX (US); Dan P. Saurer, Richardson, TX (US); Colin M. MacRae, The Woodlands, TX (US); David J. Steele, Irving, TX (US); William Sloane Muscroft, Saint Albert; Denis C. Desranleau, Sherwood Park, both of (CA)

(73) Assignee: Halliburton Energy Services, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 38 days.

(21) Appl. No.: 09/159,530

(22) Filed: Sep. 23, 1998

Related U.S. Application Data

(60) Provisional application No. 60/059,902, filed on Sep. 24, 1997, and provisional application No. 60/073,976, filed on Feb. 6, 1998.

(51) Int. Cl.[7] ..... E21B 47/00

(52) U.S. Cl. ..... 166/255.3; 166/50; 166/117.6; 166/383; 166/317

(58) Field of Search ..... 166/255.1, 255.3, 166/50, 117.6, 381, 383, 313

(56) References Cited

U.S. PATENT DOCUMENTS

| | | | | |
|---|---|---|---|---|
| 2,397,070 | | 3/1946 | Zublin | 166/4 |
| 2,797,893 | | 7/1957 | McCune et al. | 255/1.6 |
| 2,804,926 | | 9/1957 | Zublin | 166/50 |
| 2,858,107 | | 10/1958 | Colmerauer | 255/1.6 |
| 4,420,049 | | 12/1983 | Holbert | 175/45 |
| 4,848,820 | | 7/1989 | Morrell . | |
| 4,928,767 | | 5/1990 | Jelsma . | |
| 5,131,467 | * | 7/1992 | Osborne et al. | 166/117.6 |

(List continued on next page.)

FOREIGN PATENT DOCUMENTS

| | | | |
|---|---|---|---|
| 0 701 040 A2 | 3/1996 | (EP) | E21B/7/06 |
| 2297988 | 8/1996 | (GB) . | |

OTHER PUBLICATIONS

PCT International Search Report for Int'l Application No. PCT/US98/06658 filed on Apr. 3, 1998, Sep. 1998.

PCT International Search Report for Int'l Application No. PCT/US98/06653 filed on Apr. 3, 1998, Sep. 1998.

*Primary Examiner*—David Bagnell
*Assistant Examiner*—John Kreck
(74) *Attorney, Agent, or Firm*—William M. Imwalle; Marlin R. SMith

(57) ABSTRACT

A self-locating reentry system is provided to allow reliable reentry from a primary wellbore into one or more secondary wellbores. The reentry system may include one or more self-locating assemblies which may be engaged with selected portions of a lateral opening disposed between the primary wellbore and a respective secondary wellbore. Each self-locating assembly and respective key or lug cooperate with each other to provide optimum location and alignment relative to the lateral opening for communication of well tools and smaller diameter tubing strings between the primary wellbore and the associated secondary wellbore. A retaining mechanism is preferably provided to maintain the locator lug or key in its first retracted position until the reentry system is at a desired downhole location relative to the selected lateral opening.

28 Claims, 9 Drawing Sheets

U.S. PATENT DOCUMENTS

| | | | | |
|---|---|---|---|---|
| 5,154,231 | * | 10/1992 | Bailey et al. | 166/298 |
| 5,222,554 | | 6/1993 | Blount et al. | 166/117.6 |
| 5,311,936 | | 5/1994 | McNair et al. | 166/50 |
| 5,318,121 | * | 6/1994 | Brockman et al. | 166/313 |
| 5,325,924 | | 7/1994 | Bangert et al. | 166/313 |
| 5,388,648 | | 2/1995 | Jordan, Jr. | 166/380 |
| 5,425,419 | | 6/1995 | Sieber | 166/206 |
| 5,427,177 | * | 6/1995 | Jordan et al. | 166/50 |
| 5,427,179 | | 6/1995 | Bailey et al. . | |
| 5,431,219 | * | 7/1995 | Leising et al. | 166/50 |
| 5,467,819 | | 11/1995 | Braddick | 166/117.6 |
| 5,474,131 | * | 12/1995 | Jordan et al. | 166/313 |
| 5,477,925 | * | 12/1995 | Trahan et al. | 166/382 |
| 5,484,017 | | 1/1996 | Coon | 166/117.5 |
| 5,520,252 | | 5/1996 | McNair | 166/313 |
| 5,533,573 | * | 7/1996 | Jordan et al. | 166/313 |
| 5,535,822 | | 7/1996 | Schock et al. | 166/50 |
| 5,564,503 | * | 10/1996 | Longbottom et al. | 166/313 |
| 5,649,595 | * | 7/1997 | Davis et al. | 166/297 |
| 5,651,415 | * | 7/1997 | Scales | 166/250.09 |
| 5,678,634 | | 10/1997 | Rehbock et al. | 166/377 |
| 5,697,445 | * | 12/1997 | Graham | 166/313 |
| 5,715,891 | * | 2/1998 | Graham | 166/313 |
| 5,730,224 | * | 3/1998 | Williamson et al. | 166/386 |
| 5,787,987 | | 8/1998 | Forsyth et al. . | |
| 5,806,614 | * | 9/1998 | Nelson | 166/61 |

* cited by examiner

FIG. 18
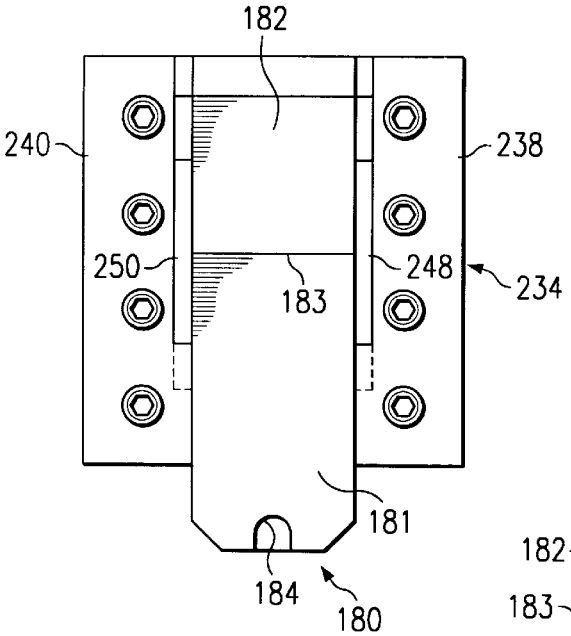
FIG. 19
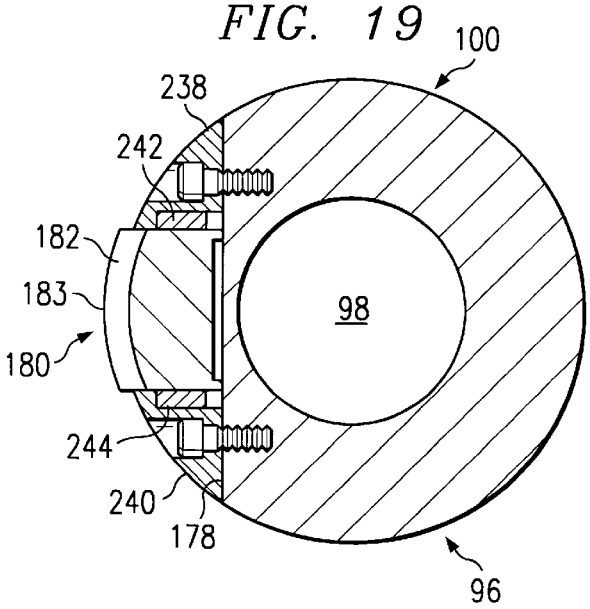
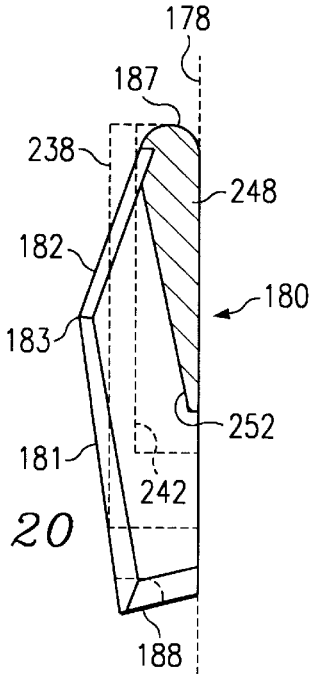
FIG. 20
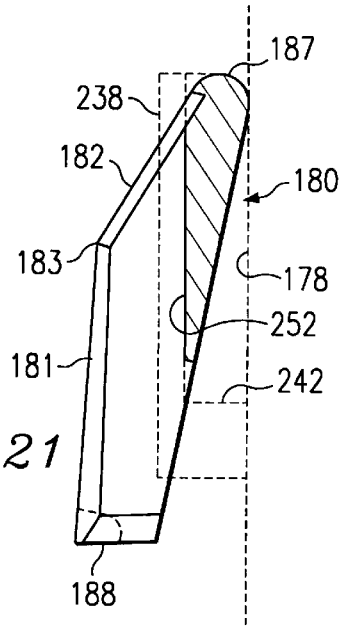
FIG. 21

SELF-LOCATING REENTRY SYSTEM FOR DOWNHOLE WELL COMPLETIONS

RELATED APPLICATIONS

This application claims the benefit of U.S. provisional application Serial No. 60/059,902 filed Sep. 24, 1997, entitled Self-Locator Lateral Reentry System, and U.S. provisional application Serial No. 60/073,976 filed Feb. 6, 1998 entitled *Hydrostatic Key Release, Self-Locator Lateral Window for Multilateral Well Completion.*

This application is related to copending provisional application Serial No. 60/073,153 filed Jan. 30, 1998 entitled *Method and Apparatus for One Trip Insertion and Retrieval of a Tool and Auxiliary Device*; copending patent application Ser. No. 09/054,365 filed Apr. 2, 1998 entitled *Method and Apparatus for Deploying a Well Tool into a Lateral Wellbore*; copending patent application Ser. No. 09/054,366 filed Apr. 2, 1998 entitled *Multilateral Whipstock and Tools for Installing and Retrieving*; and copending patent application Ser. No. 09/054,367 filed Apr. 2, 1998 entitled *Window Assembly for Multiple Wellbore Completions.*

TECHNICAL FIELD OF THE INVENTION

The present invention relates generally to a reentry system for downhole well completions having multiple wellbores, and more particularly to providing self-locating equipment and methods to allow communication of downhole tools and equipment through a window or lateral opening formed in a first wellbore and a second wellbore extending from the window or lateral opening.

BACKGROUND OF THE INVENTION

During the past several years, substantial improvement has been made in three dimensional (3D) seismic surveys to better locate and define the boundaries of underground hydrocarbon producing formations. During this same time period, substantial improvements have also been made in directional drilling and horizontal well completion techniques. As a result, many current well completions often include more than one wellbore or borehole. For example, a first, generally vertical wellbore may be initially drilled within or adjacent to one or more hydrocarbon producing formations. Multiple wellbores may then be drilled extending generally laterally from the first wellbore to respective locations or "targets" selected to optimize production from the associated hydrocarbon producing formation or formations. Such well completions are often referred to as multilateral wells.

A typical multilateral well completion may include a first or primary wellbore defined in part by a casing string and a layer of cement disposed between the exterior of the casing string and the inside diameter of the primary wellbore. The primary wellbore will generally extend from the well surface to a desired downhole location. The primary wellbore may be substantially vertical or may be slanted depending upon the location of the associated wellhead and downhole hydrocarbon producing formation or formations. For some well completions the primary wellbore may include a substantially vertical portion extending from the well surface and one or more portions which are drilled at a selected angle or angles relative to the vertical portion. The primary wellbore may also include one or more portions having an up dip or a down dip.

Directional drilling equipment and techniques may be used to form one or more exits or windows from the primary wellbore through the associated casing string and layer of cement at respective downhole locations selected for drilling secondary wellbores extending from the primary wellbore. The location and orientation of each window in the primary wellbore and the length, diameter and orientation of respective secondary wellbores relative to the primary wellbore are generally selected to optimize production from the associated hydrocarbon producing formation or formations. For many well completions such as deep offshore wells, multiple secondary wellbores will be drilled from each primary wellbore in an effort to optimize hydrocarbon production while minimizing overall drilling and well completion costs. Selective isolation and/or reentry into each of the secondary wellbores is often necessary to further optimize production from the associated hydrocarbon producing formation or formations.

A typical multilateral well completion may have one or more production tubing strings disposed within the casing string of the primary wellbore. The production tubing string or strings will have a generally uniform inside diameter extending from the well surface to a selected downhole location. A reentry window assembly, sometimes referred to as a lateral reentry window may be installed within each production tubing string at a downhole location corresponding with the location at which a secondary wellbore intersects the primary wellbore. For example, a multilateral well completion may include a primary wellbore extending substantially vertically from the well surface and three secondary wellbores extending substantially laterally from the primary wellbore at respective first, second and third downhole locations. A production tubing string with three window assemblies may be installed within the casing string of the primary wellbore using conventional well completion techniques such that each window assembly is disposed adjacent to and aligned with a respective window in the primary wellbore and associated lateral or secondary wellbore.

For some multilateral well completions, a primary wellbore may be drilled and a casing string disposed therein using conventional well drilling and completion techniques. One or more casing nipples may be installed within the casing string proximate respective downhole locations from which respective secondary wellbores will be drilled. Various types of locking mandrels and/or latches may be used to install equipment such as a whipstock in the respective casing nipple for use in forming an associated secondary wellbore extending from the primary wellbore and/or to allow reentry from the primary wellbore to the secondary wellbore.

For other multilateral well completions, a primary wellbore may be drilled and a casing string disposed therein using conventional well drilling and completion techniques. A whipstock packer may then be installed within the casing string of the primary wellbore proximate a desired location for drilling a secondary wellbore extending therefrom. When drilling and completion of the secondary wellbore has been completed, the associated whipstock packer may be removed from the primary wellbore to allow access through the primary wellbore to other downhole hydrocarbon producing formations. The same or another whipstock packer may be installed in the primary wellbore at another location for use in forming an additional secondary wellbore extending therefrom. Whipstock packers may also be used to reenter a secondary wellbore extending from primary wellbore. However, production tubing strings and other downhole equipment must often be removed from the primary wellbore before a whipstock packer can be placed therein. After removal of the associated whipstock packer, it may often be difficult to locate a window in the casing and to align equipment with the window for reentry from the primary wellbore into the respective secondary wellbore on a reliable, consistent basis.

SUMMARY OF THE INVENTION

In accordance with teachings of the present invention, disadvantages and problems associated with previous systems and equipment for reentering secondary wellbores extending from a primary wellbore have been substantially reduced or eliminated. Requirements for specialized locator and locking mechanisms for reentry into secondary wellbores are substantially reduced or eliminated. In one embodiment, the present invention provides repeatable access or reentry into a secondary wellbore drilled from an exit or window in a primary wellbore. Self-locating well tools and assemblies having keys or lugs formed in accordance with teachings of the present invention may engage selected portions of a window or exit formed in the primary wellbore.

Technical benefits of the present invention include providing self-locating well tools which may be used to find an exit or window in a primary wellbore after equipment used to form a secondary wellbore extending therefrom such as a drilling whipstock have been removed from the primary wellbore. Multiple secondary wellbores may be formed from a primary wellbore and successfully reentered as often as desired without requiring placement of restrictions in the primary wellbore to indicate the location of each secondary wellbore extending therefrom. Self-locating well tools incorporating teachings of the present invention allow reentry into a secondary wellbore without requiring temporary installation of a whipstock packer in the associated primary wellbore or permanent installation of restrictions such as casing nipples in the primary wellbore during initial completion of the well.

Another aspect of the present invention includes providing downhole well tools having self-locating lugs or keys which may be releasably held in a retracted position until the respective well tool is in the vicinity of a selected window or exit formed in a primary wellbore. Various types of mechanisms may be used to releasably hold the self-locating key or lug in its first, retracted position. For some applications the releasing mechanism may be activated by rotation of a tubing string attached to the well tool. For other applications the releasing mechanism may be activated in response to hydrostatic pressure of well fluids in the associated wellbore. Alternatively, the releasing mechanism may be activated in response to hydraulic pressure supplied from the well surface through an associated tubing string or through an annulus between the tubing string and a casing string. For still other applications the releasing mechanism may be activated in response to electrical or mechanical timing devices, to selected electromagnetic and/or sonic signals transmitted from the well surface or a combination of these mechanisms. Hydraulic actuators and/or hydraulic motors may be included as part of a releasing mechanism.

Further technical benefits of the present invention include maintaining self-locating key or lug in its retracted position until the associated well tool has passed through equipment at the well surface such as blowout preventers, master valves and any restrictions or irregularities within the primary wellbore. Retaining the locator lug or key in its first, retracted position will prevent damage to the primary wellbore and/or to the associated well tool.

A self-locating assembly having a lug or key incorporating teachings of the present invention provides positive orientation and depth control of the assembly relative to a window formed in a primary wellbore and a secondary wellbore extending therefrom. Often the specific location and orientation of a window formed in a primary wellbore may vary as much as forty-five degrees (45°) from the orientation of a whipstock or other downhole tool used to position drilling or milling equipment used to form the window due to torque characteristics associated with drilling/milling tools and techniques. A self-locating assembly having a lug or key incorporating teachings of the present invention provides precise, positive indication of alignment at an optimum location relative to a selected window in a primary wellbore. The self-locating assembly may be used with coiled tubing servicing and/or wireline servicing of a secondary wellbore. The self-locating assembly may be selectively engaged with one of several windows formed in a primary wellbore. The self-locating assembly may include various types of whipstocks to direct well tools and small diameter tubing strings from a primary wellbore into a secondary wellbore extending therefrom.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which:

FIG. 18 is a schematic drawing in section showing a self-locating window assembly having a lug or key incorporating teachings of the present invention;

FIG. 19 is a schematic drawing in section and in elevation with portions broken away showing a locator lug incorporating teachings of the present invention in its first retracted position; and FIG. 20 is a schematic drawing and in elevation with portions broken away showing a locator lug or key incorporating teachings of the present invention in its second, expanded position.

DETAILED DESCRIPTION OF THE INVENTION

Preferred embodiments of the present invention and its advantages are best understood by referring now in more detail to FIGS. 1–20 of the drawings, in which like numerals refer to like parts.

The terms "multilateral wellbores" and "multilateral wells" are used to describe downhole well completions having a primary wellbore and one or more secondary wellbores extending therefrom. Multilateral wells may generally be divided into two general types or categories. The first general type includes multilateral wells which are initially drilled and completed with a primary wellbore and one or more secondary wellbores extending therefrom. The second general type includes multilateral wells which were initially drilled and completed with only a primary wellbore. At some later date, the primary wellbore may be reentered with directional drilling equipment to form one or more secondary wellbores extending therefrom.

As previously noted, a primary wellbore often extends generally vertically from the well surface to a desired downhole location. However, primary wellbores may have a wide variety of configurations other than substantially vertical. Secondary wellbores often extend generally laterally from the associated primary wellbore. However, secondary wellbores may also have a wide variety of configurations including up angles or up dips and down angles or down dips relative to the primary wellbore. Some multilateral well configurations also include a first or primary wellbore extending from the well surface to a selected downhole location, a second wellbore extending substantially laterally from the first wellbore, and one or more additional wellbores extending from the second wellbore. Well tools and self-locating assemblies incorporating teachings of the present invention may be satisfactorily used with a wide variety of downhole well completions having a primary wellbore with at least one secondary wellbore extending therefrom.

Figure 1:
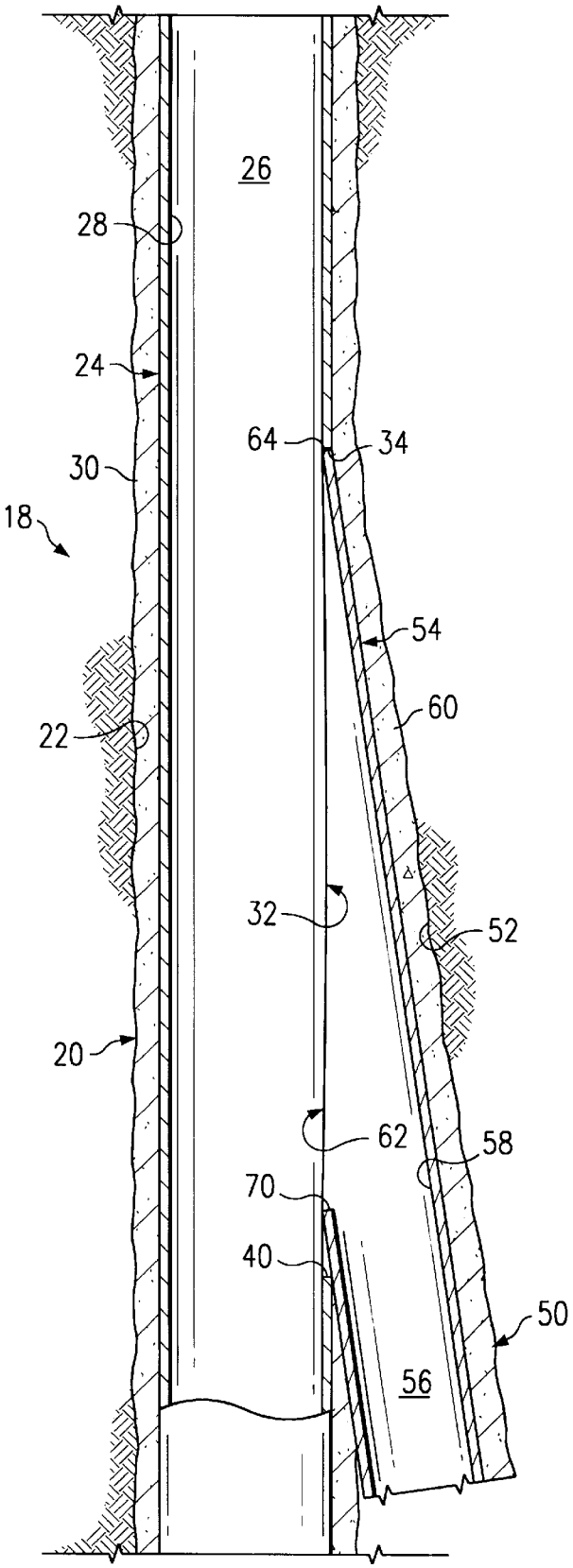
FIG. 1 is a schematic drawing in section and in elevation with portions broken away showing a primary wellbore defined in part by a casing string and a secondary wellbore defined in part by a liner extending from a window formed in the casing string.
Figure 7:
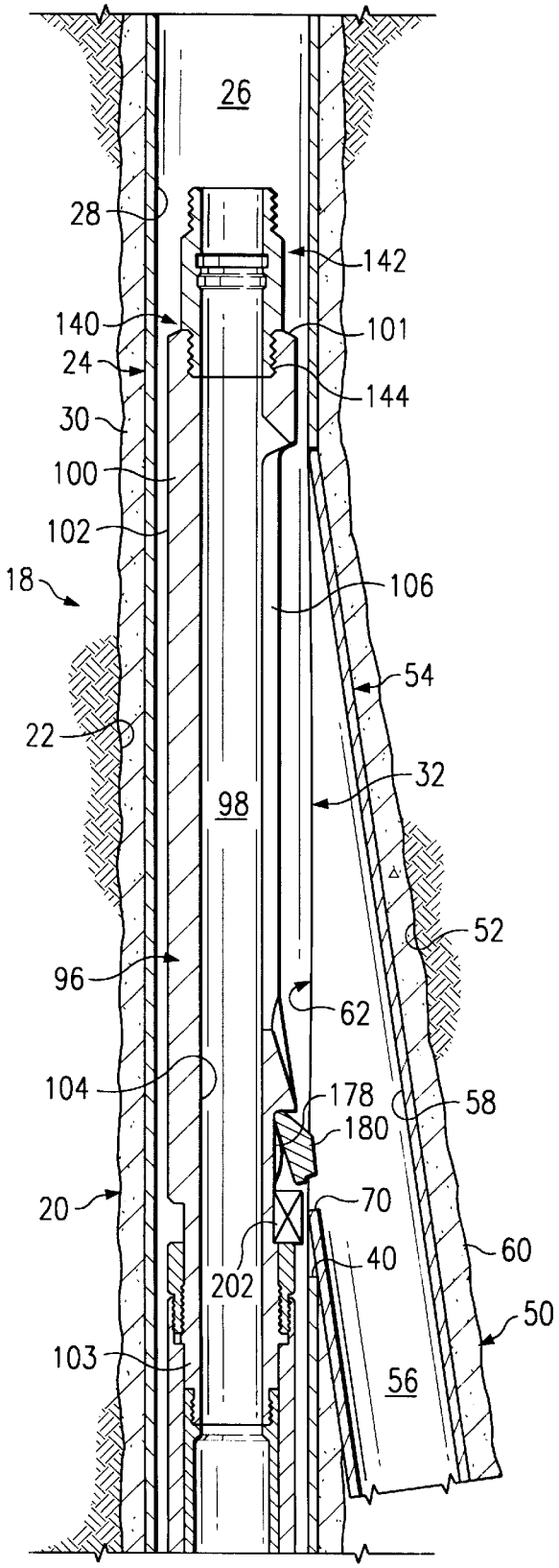
FIG. 7 is a schematic drawing in section and in elevation with portions broken away showing another embodiment of a reentry system having a lug or key for locator the reentry system adjacent to and aligned with a window in a primary wellbore in accordance with teachings of the present invention.

Well completion 18 as shown in FIGS. 1 and 7 includes primary wellbore 20 and secondary wellbore 50 extending therefrom. Well completion 18 may be initially drilled and completed as shown in FIG. 1, or primary wellbore 20 may be initially drilled and completed using conventional well drilling techniques and later reentered to form secondary wellbore 50. Primary wellbore 20 is defined in part by sidewall 22 which corresponds generally with the inside diameter of wellbore 20 as initially drilled from the well surface (not expressly shown). Primary wellbore 20 also includes casing string 24 with longitudinal bore 26 extending therethrough. Inside diameter 28 of casing string 24 defines in part longitudinal bore 26. Layer or sheath 30 of cement is preferably disposed between the exterior of casing string 24 and sidewall 22.

Secondary wellbore 50 is defined in part by sidewall 52 which corresponds with the inside diameter of secondary wellbore 50 as initially drilled from primary wellbore 20. Secondary wellbore 50 also includes liner 54 with longitudinal bore 56 extending from primary wellbore 20 to a desired location or target in an adjacent hydrocarbon producing formation (not expressly shown). Inside diameter 58 of liner 54 defines in part longitudinal bore 56. Layer or sheath 60 of cement is preferably disposed between the exterior of liner 54 and sidewall 52.

Primary wellbore 20 may be formed using conventional drilling and completion equipment associated with oil and gas wells. Various types of directional drilling equipment, such as a retrievable whipstock packer (not expressly shown) may be installed within longitudinal bore 26 of casing string 24 proximate the desired location for secondary wellbore 50. Various types of milling tools may be satisfactorily used to form window or exit 32 in casing string 24 at the desired downhole location. Window 32 provides an opening extending generally laterally from longitudinal bore 26 through the selected portion of casing string 24.

Figure 2:
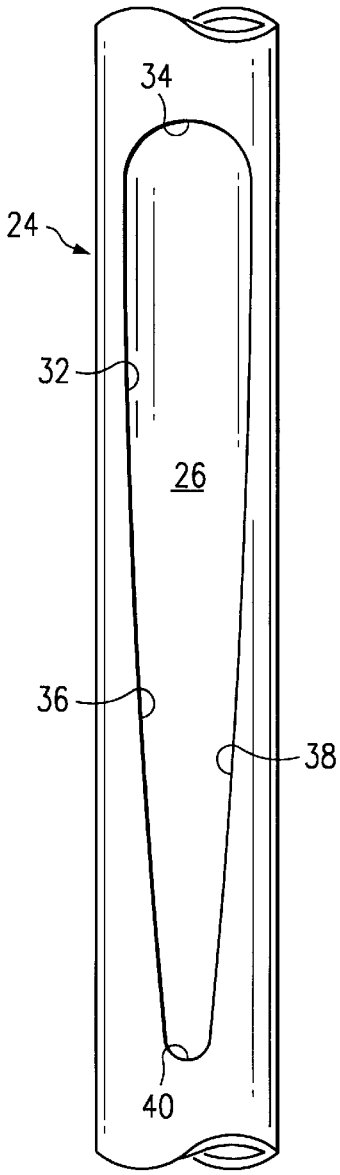
FIG. 2 is a schematic drawing in section and in elevation with portions broken away showing the exit or window formed in a portion of the casing string associated with the primary wellbore of FIG. 1.
Figure 3:
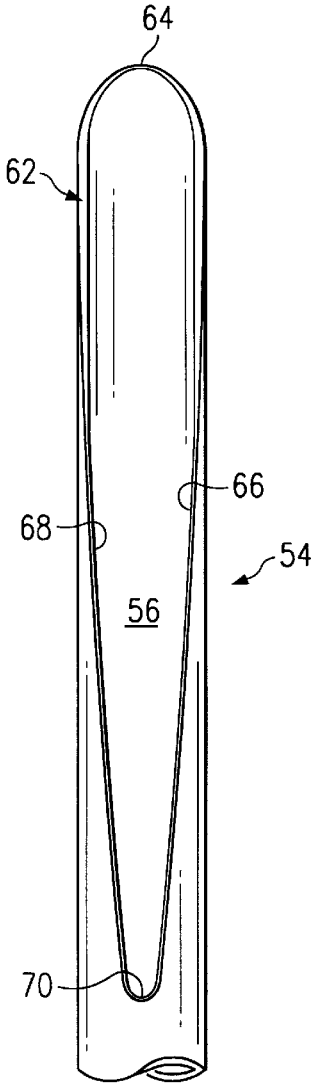
FIG. 3 is a schematic drawing in section and in elevation with portions broken away showing one end of the liner associated with the secondary wellbore of FIG. 1.

Conventional directional drilling equipment may then be used to form secondary wellbore 50 extending from window 32 to the desired location or "target" in an adjacent hydrocarbon producing formation (not expressly shown). Conventional drilling and completion equipment may be used to install liner 54 extending from window 32 through secondary wellbore 50 to the desired target. Cement layer or sheath 60 may then be formed between the exterior of liner 54 and side wall 52. After cement layer 60 has properly set or dried, various types of milling tools such as a washover mill may be used to establish a generally smooth transition between the end of liner 54 adjacent to primary wellbore 20 and longitudinal bore 26 of casing 24. As a result of the milling action associated with forming window 32 to provide a lateral opening from longitudinal bore 26 through casing string 24 and the milling operation associated with providing a generally smooth transition between the end of liner 54 adjacent to wellbore 20 and casing string 24, both window 32 in casing 24, as best shown in FIG. 2, and opening 62 formed on the end of liner 54, as best shown in FIG. 3, have substantially the same generally elliptical or tear drop shaped configuration.

When secondary wellbore 50 is drilled from primary wellbore 20, movement of the associated drill bit or milling tool (not expressly shown) will generally form elongated tear drop shaped window or exit 32 in casing string 24 of primary wellbore 20. Window 32 will typically have what may be referred to as a sweet spot, or an area near proximate end 34, which is designed to be large enough to receive casing or liner 54 which extends into secondary wellbore 50. The remainder of window 32 will generally be too small to allow liner 54 to be inserted through it. Liner 54 will preferably extend through the sweet spot or the largest diameter portion near first end 34 of window 32. Technical benefits of the present invention include providing a lug or key that will engage window 32 and/or opening 62 to provide a reference point so that other well tools may be aligned with the sweet spot or portion of window 32 having the largest diameter to allow communication of well tools and smaller diameter tubing strings with longitudinal bore 56 of liner 54.

Window 32 formed in the exterior of casing 24 has a generally elliptical configuration defined in part by first end 34. A pair of tapered surfaces 36 and 38 extend from first end 34 to second end 40. First end 34 of window 32 is defined in part by a radius which corresponds approximately with the radius of the milling tool used to form window 32.

Opening 62 formed on the end of liner 54 adjacent to window 32 also has a generally elliptical configuration defined in part by first end 64 formed at the extreme end of liner 54. A pair of tapered surfaces 66 and second end 68 extend from first end 64 to second end 70. First end 64 of opening 62 is defined in part by a radius which corresponds approximately with the radius of liner 54. Second end 70 is defined in part by a radius which is similar to the radius associated with second end 40 of window 32. As a result of the milling and washover techniques, opening 62 in liner 54 has approximately the same configuration and shape as window 32 formed in casing string 24. First ends 34 and 64, second ends 40 and 70, and tapered surfaces 36, 66, 38 and 68 are often more complex than shown in FIGS. 2 and 3, depending upon factors such as the type of milling tool used to form the respective openings and the angle of intersection between primary wellbore 20 and secondary wellbore 50.

Figure 4:
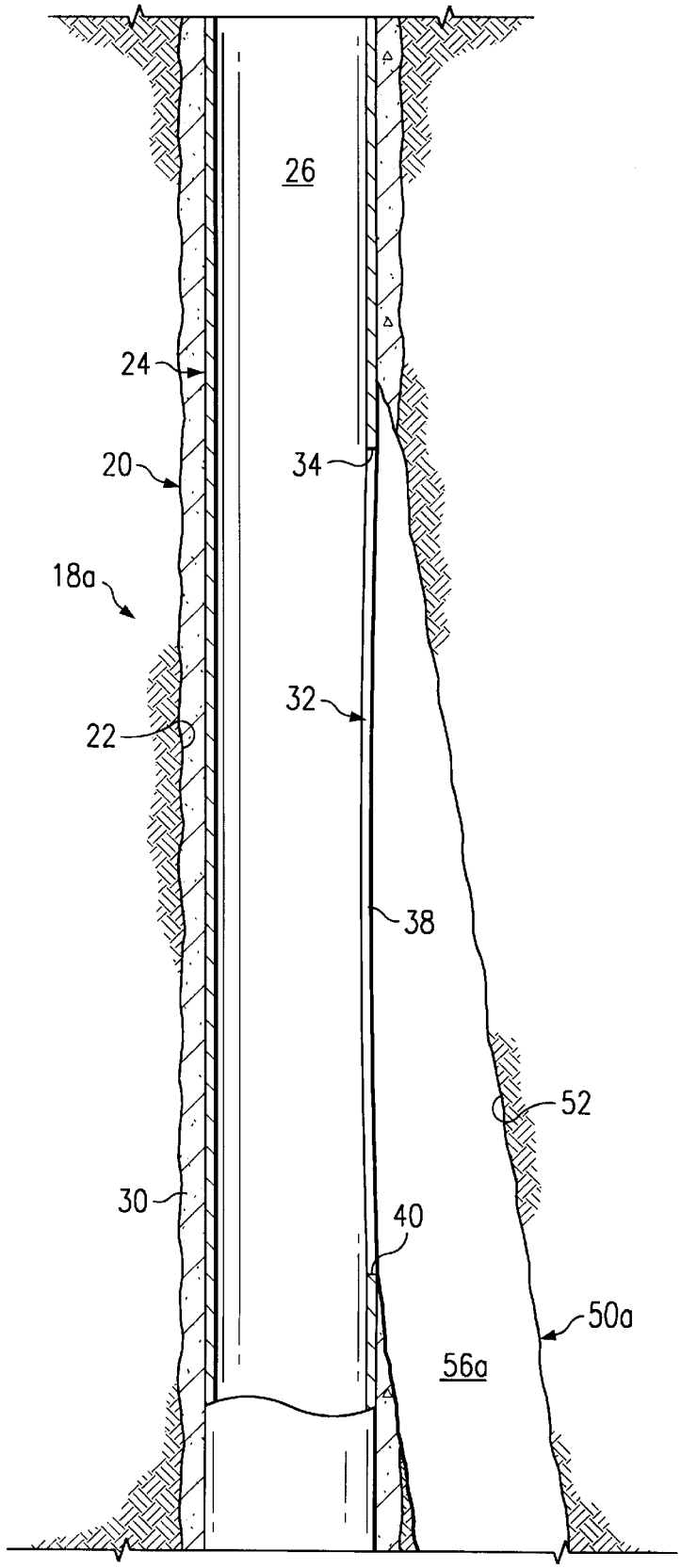
FIG. 4 is a schematic drawing in section and in elevation with portions broken away showing a primary wellbore defined in part by a casing string and an open hole secondary wellbore extending from a window formed in the casing string.
Figure 6:
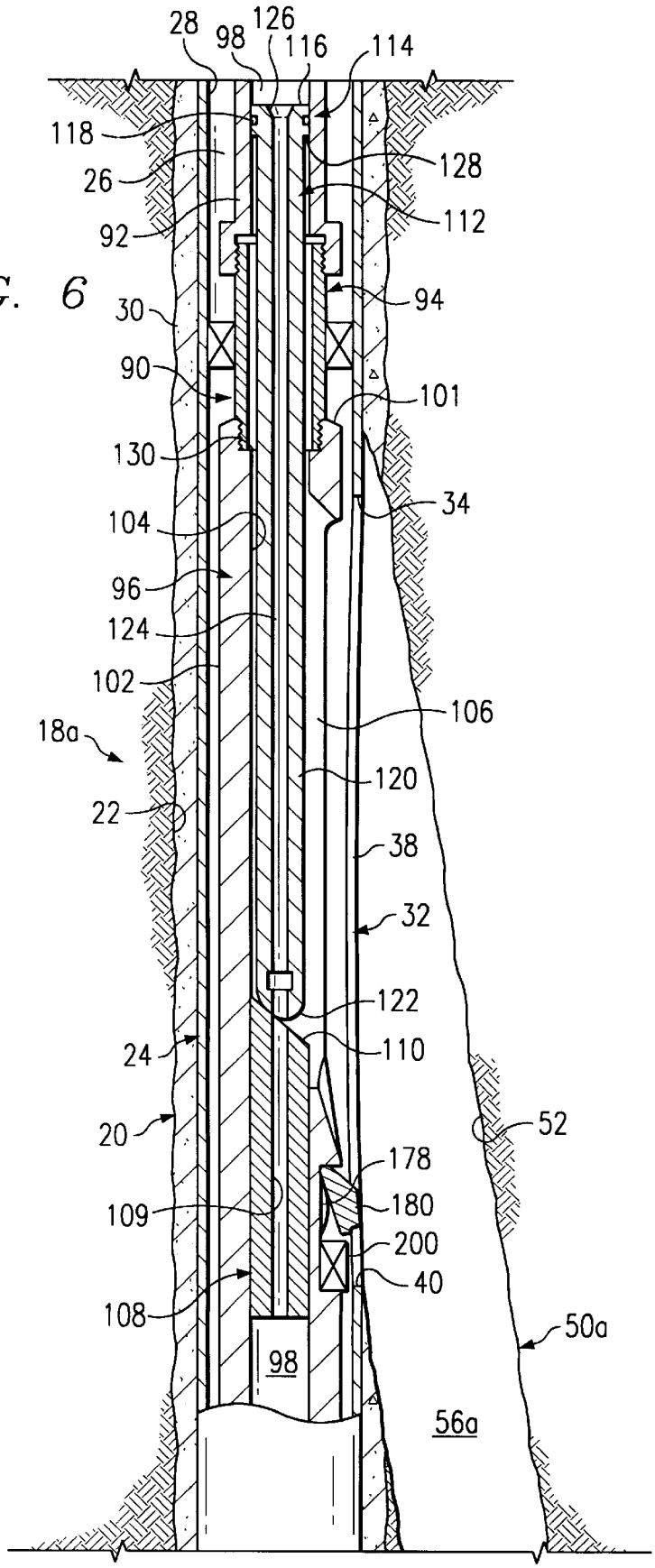
FIG. 6 is a schematic drawing in section and in elevation with portions broken away showing one embodiment of a reentry system having a lug or key for locator the reentry system adjacent to and aligned with a window in a primary wellbore in accordance with teachings of the present invention.

Well completion 18*a* as shown in FIGS. 4 and 6 is similar to well completion 18 accept secondary wellbore 50*a* does not include liner 54 or cement layer 60. As a result, longitudinal bore 56*a* of secondary wellbore 50*a* has a generally larger inside diameter as compared to longitudinal bore 56 of secondary wellbore 50. Secondary wellbore 50*a* may sometimes be referred to as a "open hole" completion.

As previously noted, the configuration and shape of window 32 formed in the exterior of casing string 22 corresponds generally with the configuration and shape of elliptical opening 62 formed on the end of liner 54 disposed adjacent to primary wellbore 20. Although there will be some variation in dimensions such as length and width, both window 32 and elliptical opening 62 have substantially the same "sweet spot" or optimum position for communicating well tools and small diameter tubing strings between primary wellbore 20 and secondary wellbore 50*a*. As discussed later in more detail, a lug or key may be disposed in the exterior of various types of self-locating well tools and assemblies in accordance with teachings of the present invention for use in positioning the respective well tool or assembly adjacent to and aligned with window 32.

Figure 14:
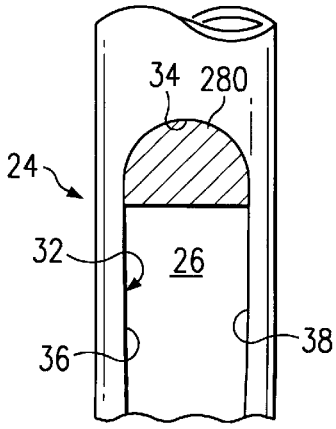
FIG. 14 is a schematic drawing in section and in elevation with portions broken away showing another embodiment of a self-locating lug or key engaged with a window formed in a primary wellbore in accordance with teachings of the present invention.

For those applications in which secondary wellbore 50 extending from window 32 includes liner 54 such as shown in FIG. 1, a locator lug or key may be engaged with selected portions of elliptical opening 62 such as tapered surfaces 66 and 68 and/or second end 70. For those applications such as shown in FIG. 4 in which secondary wellbore 50*a* extending from window 32 does not include a liner, a locator lug or key may be engaged with selected portions of window 32 such as tapered surfaces 36 and 38 and/or second end 40. For still other applications such as shown in FIG. 14, a locator lug or key incorporating teaching of the present invention may be engaged with first end 34 of window 32.

For purposes of describing various aspects of the present invention, the term "lateral opening" may be used to describe either window 32 in casing string 24 and/or elliptical opening 62 formed on the end of liner 54. A self-locating assembly may be engaged with selected portions of a lateral opening between a primary wellbore and a secondary wellbore in accordance with teachings of the present invention.

Figure 5:
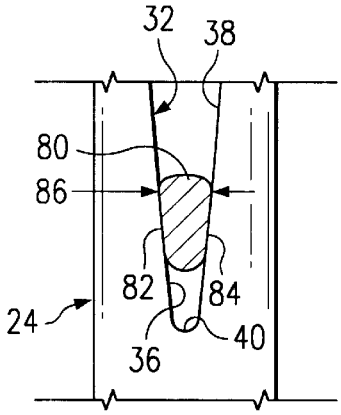
FIG. 5 is a schematic drawing in section and in elevation with portions broken away showing a self-locating lug or key engaged with a window formed in a primary wellbore in accordance with teachings of the present invention.

For purposes of explaining various features of the present invention, lug 80 is shown in FIG. 5 engaged with tapered surfaces 36 and 38 of window 32 in casing 24. However, lug 80 would appear substantially the same when engaged with elliptical opening 62 formed on the end of liner 54 adjacent to primary wellbore 20. For the embodiment shown in FIG. 5, lug 80 has a generally wedge shaped cross section defined in part by tapered surfaces 82 and 84 which correspond approximately with tapered surfaces 36 and 38. The specific dimensions associated with tapered surfaces 82 and 84 may be selected to avoid forming a "sticking" taper with respect to tapered surfaces 36 and 38 of window 32.

For other applications, a locator lug or key incorporating teachings of the present invention may have a generally circular cross-section, oval cross-section, rectangular cross-section or a combination of such cross-sections to provide the desired type of engagement between the respective locator lug or key and a lateral opening in a primary wellbore. Often, the dimensions and configuration of a locator lug or key will be selected to minimize stress in the portions of the lateral opening which are in direct engagement with the locator lug or key.

Due to the angle of intersection at which secondary wellbore 50 intersects primary wellbore 20 and the generally elliptical configuration of window 32 and opening 62, an optimum position exists within longitudinal bore 26 proximate window 32 for inserting well tools and smaller diameter tubing strings between first wellbore 20 and second wellbore 40. The dimensions and configuration of locator lug 80 may be varied to insure that the associated well tool or assembly is positioned at the optimum location relative to window 32 to minimize any interference between movement of well tools or smaller diameter tubing strings between primary wellbore 20 and secondary wellbore 50.

Thickness 86 of lug 80 as measured between tapered surfaces 82 and 84 may be varied to determine the elevation at which lug 80 will engage window 32 relative to second end 40. For example, by increasing thickness 86 of lug 80, the distance or elevation at which lug 80 engages tapered surfaces 36 and 38 relative to second end 40 will increase. In a similar manner decreasing thickness 86 of lug 80 will result in engagement with tapered surfaces 36 and 38 of window 32 at a distance or elevation closer to second end 40. For some applications, the dimensions of lug 80 may be selected to allow engagement with second end 40 of window 32 or second end 70 of elliptical opening 62. One of the technical benefits of the present invention includes the ability to vary the dimensions and configurations of a locator lug or key to adjust the position of an associated well tool or assembly relative to window 32 when the lug or key is engaged with selected portions of window 32.

Self-locating well tools and assemblies having a key or lug incorporating teachings of the present invention may be satisfactorily used in multilateral well completions in which the associated secondary wellbores are either completed with a liner such as liner 54 shown in FIGS. 1 and 7 or an open hole completion such as shown in FIGS. 4 and 6. Various types of well tools such as lateral reentry window assemblies, whipstocks, wellbore isolation tools and downhole flow control may be formed with a locator lug or key in accordance with teachings of the present inventions.

FIG. 6 is a schematic drawing showing self-locating assembly 90 disposed within longitudinal bore 26 of casing string 24 adjacent to window 32. For the embodiment of the present invention as shown in FIG. 6, self-locating assembly 90 preferably includes running tool 92 which may be secured to a tubing string such as a drill string (not expressly shown), a workover string (not expressly shown) or a well completion tubing string (not expressly shown). The tubing string attached to running tool 92 may be used to move self-locating assembly 90 from the well surface to a desired downhole location within longitudinal bore 26.

Depending upon various factors such as the type of well tools or small diameter tubing strings which may be inserted into secondary wellbore 50*a*, the type of well servicing operations which may be conducted in secondary wellbore 50*a*, the presence of other secondary wellbores (not expressly shown) extending from primary wellbore 20 and other characteristics associated with primary wellbore 20, a well packer (not expressly shown) may be installed within casing string 24 below window 32 to provide fluid isolation between secondary wellbore 56*a* and portions of primary wellbore 20 below the well packer. Other types of downhole completion equipment and well tools may also be installed in primary wellbore 20 below window 32 as desired. Depending upon the type of work which will be performed in secondary wellbore 50*a*, and the type of well tools included as part of self-locating assembly 90, it may be desirable to have an accurate indication of the distance between window 32 and any equipment installed within casing string 24 below window 32.

For some applications, self-locating assembly 90 may include well packer 94 to form a fluid barrier within casing string 24 at a selected location above window 32. For many types of well servicing applications it may be preferable to install well packers within casing string 24 above and below window 32 to provide fluid isolation between secondary wellbore 50*a* and other portions of longitudinal bore 26. For some applications, running tool 92 may be releasably secured to well packer 94. Various types of running tools and well packers may be satisfactorily used with the present invention. For example, well packer 94 may be a "G-10 retrievable packer" which is commercially available from Dresser Oil Tools located in Dallas, Tex.

For the embodiment of the present invention as shown in FIG. 6, self-locating assembly 90 preferably includes window assembly 96 which is attached to and extends from well packer 94. Various types of window assemblies may be satisfactorily used with the present invention. One example of a window assembly which may be satisfactorily used with the present invention is shown and described in co-pending U.S. patent application Ser. No. 09/054,367 entitled *Window Assembly For Multiple Wellbore Completions*, now U.S. Pat. No. 5,964,287. Tubing window assemblies satisfactory for use with the present invention are available from Dresser Oil Tools located in Dallas, Tex.

Running tool 92, well packer 94, and window assembly 96 are preferably concentrically aligned with each other to form longitudinal bore 98 extending therethrough. A similar longitudinal bore (not expressly shown) is also provided in the tubing string attached to running tool 92. Therefore, various types of well tools, small diameter tubing strings such as coiled tubing and various types of well completion and workover fluids may be communicated between the well surface and secondary wellbore 50*a* through the tubing string attached to running tool 92 and longitudinal bore 98.

Window assembly 96 preferably includes elongated housing 100 with longitudinal bore 98 extending therethrough. Housing 100 includes first end 101 which may be attached to well packer 94. Housing 100 also includes second end 103. See FIGS. 7 and 8. For some applications, second end 103 of housing 100 may be connected by additional joints of tubing and other well tools with a well packer (not expressly shown) installed within casing string 24 below window 32. Various types of mechanical connections and coupling may be satisfactorily used to attach housing 100 with well packer 94.

Housing 100 has a generally cylindrical configuration which includes exterior surface 102 and interior surface 104. The outside diameter of housing 100 is selected to be compatible with inside diameter 28 of casing string 24. Elongated slot 106 is preferably formed in and extends through exterior surface 102 and interior surface 104 of housing 100 to allow communication of well tools, smaller diameter tubing strings and/or well treating fluids between longitudinal bore 98 and the exterior of window assembly 96. The length and width of elongated slot 106 are preferably selected to allow movement of well tools from longitudinal bore 98 into secondary wellbore 50*a*.

For the embodiment of the present invention as shown in FIG. 6, tubing exit whipstock 108 is preferably disposed within longitudinal bore 98 of window assembly 96. Fluid flow passageway 109 may be formed in tubing exit whipstock 108 to allow fluid communication through longitudinal bore 98. Tubing exit whipstock 108 is preferably installed within window assembly 96 for use in deflecting well tools and smaller diameter tubing strings from longitudinal bore 98 into secondary wellbore 50*a*. Tubing exit whipstock 108 preferably includes tapered surface 110. The dimensions and configuration of tapered surface 110 are preferably selected such that when window assembly 96 is positioned at the desired location relative to window 32 formed in casing string 24 a generally smooth transition will be provided for movement of well tools between primary wellbore 20 and secondary wellbore 50*a* through the "sweet spot" in window 32.

Locator lug or key 180 is preferably disposed within the exterior of housing 100 below elongated slot 106 adjacent to tubing exit whipstock 108. For the embodiment of the present invention as shown in FIG. 6, locator lug or key 180 is preferably disposed within recess 178 formed in the exterior of housing 100. One end of lug 180 may be rotatably disposed within recess 178 to allow movement of lug 180 between its first retracted position and a position radially extending from housing 100.

The dimensions of lug 180 are selected in accordance with teachings of the present invention so that when locator lug 180 engages window 32, tapered surface 110 of tubing exit whipstock 108 will be at the optimum position for directing well tools and small diameter tubing strings to move from longitudinal bore 98 through the "sweet spot" in window 32 and into secondary wellbore 50*a*. For some applications, the dimensions of locator lug 180 may be selected such that when lug 180 engages tapered surfaces 36 and 38 of window 32, tapered surface 110 of tubing exit whipstock 108 will be at its optimum position. For other applications, the dimensions of lug 180 may be selected such that when lug 180 engages either first end 34 or second end 40 of window 32, tapered surface 110 of tubing exit whipstock 108 will be at its optimum position.

Various downhole surveying techniques may be used to obtain detailed knowledge concerning the dimensions of a lateral opening formed in a primary wellbore so that a locator lug or key and associated self-locating assembly may be formed with appropriate dimensions to ensure alignment with the "sweet spot" in the selected lateral opening. The previous description of locator lug or key 180 also apply to those applications in which locator lug or key 180 will be engaged with elliptical opening 162 formed in the end of liner 54. The position in which a lug or locator key engages either a window in a primary wellbore or an elliptical opening formed in the end of a liner, may also be selected at least in part upon the strength of the associated casing and/or liner and respective load carrying capability.

For some applications, a locator lug or key incorporating teachings of the present invention may be biased radially outward from the associated housing such that the locator key or lug will generally rub against or ride along inside diameter 28 of casing 24. The dimensions and exterior configuration of this type of locator lug or key (not expressly shown), are preferably selected to minimize any possibility of the locator lug or key engaging a restriction in equipment installed at the well surface or a restriction within casing string 24.

For some well completions, secondary wellbore 50*a* may be located at a considerable depth below the well surface. For such well completions it may not be practical or technically feasible to install a continuous length of large diameter casing from the well surface to the desired location for secondary wellbore 50*a*. Therefore, casing string 24 as shown in FIG. 6 may be a portion of a liner extending from a larger casing string (not expressly shown). A liner hanger (not expressly shown) is typically used to install a liner within a larger diameter casing string. Therefore, a locator key or lug will often be maintained in a retracted position until after the associated well tool has moved through any restrictions 20 such as the transition between a large diameter casing and a liner disposed within the large diameter casing.

Locator key or lug 180 preferably has a first, retracted position which will allow self-locating assembly 90 to pass through various restrictions such as blow out preventers and/or other types of well control equipment (not expressly shown) which may be installed at the well surface. Also, maintaining locator key or lug 180 in its first, retracted position will allow self-locating assembly 90 to more easily pass through restrictions or irregularities which may be present within casing string 24. If locator key or lug 180 is allowed to move to its extended position as shown in FIG. 6, end 188 of locator lug or key 180 may engage the top of a liner hanger or other restriction within primary wellbore 20*a* and prevent movement of self-locating assembly 90 to the desired downhole position adjacent to window 32.

Various types of mechanisms may be provided in accordance with teachings of the present invention to maintain locator key or lug 180 in its first, retracted position. For example, a shear pin (not expressly shown) may be inserted between portions of locator key or lug 180 and adjacent portions of recess 178. For this embodiment, locator lug or key 180 may extend partially from recess 178 such that when the associated housing enters a restricted or reduced diameter portion of primary wellbore 20, locator lug or key 180 will be forced radially inward to shear the associated shear pin. Locator lug or key 180 would then be allowed to extend radially outward to a position such as shown in FIG. 6. This type of releasing mechanism may function satisfactorily as long as there are no restrictions in the equipment located at the well surface or within primary wellbore 20 that would result in premature release of locator lug or key 180. Also, inadvertent side impacts with the associated housing may result in undesired release of locator lug or key 180.

For some applications, retaining mechanism 200 may be provided adjacent to locator key or lug 180. Self-locating assembly 90 may be positioned within casing string 24 at a selected distance either above or below window 32. The tubing string attached to running tool 92 may then be manipulate by raising, lowering and/or rotating as appropriate to cause retaining mechanism 200 to release locator key or lug 180 from its first, retracted position. Various types of mechanical devices (not expressly shown) such as drag blocks, bow springs, j-Hatches and/or shear pins may be provided to allow retaining mechanism 200 to release locator lug or key 180 in response to manipulation of the associated tubing string. For other applications retaining mechanism 200 may include a downhole hydraulic motor or a downhole hydraulic actuator for use in releasing locator lug or key 180.

After self-locating assembly 90 has been properly manipulated to release locator lug or key 180, self-locating assembly 90 may be moved to a location proximate window 30. The tubing string attached to running tool 92 may then be rotated until an indication is obtained that locator lug 180 is engaged with window 32. The tubing string and running tool 92 may then be lowered until an indication is received that locator lug or key 180 is engaged with tapered surfaces 36 and 38 of window 32. The tubing string may be raised and lowered several times and/or rotated clockwise and counterclockwise several times to satisfactorily confirm that locator lug or key 180 is satisfactorily engaged with window 32. Other mechanisms such as downhole hydraulic motors and/or downhole hydraulic actuators (not expressly shown) may also be used to manipulate self-locating assembly 90 to establish satisfactory engagement between locator lug or key 180 and the selected window 32. self-locating assembly having a locator lug or key incorporating teachings of the present invention is not limited to use with a tubing string that is manipulated at the well surface.

For some applications, telescoping assembly 112 may be slidably disposed within longitudinal bore 98 extending through running tool 92, well packer 94, and window assembly 96. Piston assembly 114 is preferably disposed adjacent to first end 116 of telescoping assembly 112 located within running tool 92. The dimensions of piston assembly 114 and the inside diameter of running tool 92 are preferably selected such that elastomeric seal ring 118 will form a generally fluid tight seal with the portions of longitudinal bore 98 disposed adjacent thereto.

Elongated hollow tube 120 is preferably attached to and extends from piston assembly 114. End 122 of hollow tube 120 opposite from piston assembly 114 preferably has a generally spherical configuration selected to be compatible with tapered surface 110 of tubing exit whipstock 108. End 122 of hollow tube 120 corresponds generally with the second end of telescoping assembly 112. Fluid flow passageway 124 preferably extends longitudinally through telescoping assembly 112 from piston assembly 114 to second end 122.

Ball seat 126 is preferably formed as part of fluid flow passageway 124 adjacent to first end 116. A small ball or dart (not expressly shown) may be inserted from the well surface through longitudinal bore 98 to form a fluid seal with ball seat 126. Fluid pressure may then be applied from the well surface through the associated tubing string and longitudinal bore 98 to piston assembly 114 which will force telescoping assembly 112 to move from its first position as shown in FIG. 6 to a second position in which elongated hollow tube 120 extends radially outward through elongate slot 106 and window 32 into secondary wellbore 50*a*.

Shoulders 128 may be formed on piston assembly 114 facing corresponding shoulders 130 formed on interior window assembly 96. Shoulders 128 and 130 cooperate with each other to limit longitudinal movement of telescoping assembly 112 from its first position to its second position. Shear pins or other releasable mechanisms (not expressly shown) may be used to releasably secure telescoping assembly 112 in its first position as shown in FIG. 6.

For some applications elongated hollow tube 120 may extend between five feet and ten feet from window 32 into secondary wellbore 56*a* when telescoping assembly 112 is in its second position. Movement of telescoping assembly 112 from its first position to its second position will confirm that elongated slot 106 is satisfactorily aligned with window 32 and that well tools or small diameter tubing strings similar is size to elongated hollow tube 120 may satisfactorily move from longitudinal bore 98 into secondary wellbore 56*a*. Various mechanisms (not expressly shown) may be provided as part of running tool 92 to provide an indication at the well surface that elongated hollow tube 120 has satisfactorily moved into secondary wellbore 56*a*. For example, a series of shear pins (not expressly shown) may be included within running tool 92 to monitor movement of telescoping assembly 112. As piston assembly 114 moves longitudinally from its first position shown in FIG. 6, one or more shear pins may be engaged every five or six inches to cause a fluid pressure buildup at the well surface and then a decrease in fluid pressure as piston assembly 114 as the respective shear pin or shear pins are parted. In this manner, pressure recording equipment at the well surface can indicate movement of telescoping assembly 112 in increments of five or six inches from its first position to its second position.

For other applications, one or more ports (not expressly shown) may be formed in the exterior of running tool 92 located below piston assembly 114 when telescoping assembly 112 is in its first position. When telescoping assembly 112 moves to its second position, the associated port or ports will be open to allow fluid communication between the interior and exterior of running tool 92. The resulting change in fluid pressure within longitudinal bore 98 will be indicated at the well surface. In addition to indicating movement of telescoping assembly 112, such ports will also avoid having to pull a "wet string" during removal of running tool 92 and the attached tubing string from primary wellbore 20.

For some applications, well packer 94 may be releasably engaged with inside diameter 28 of casing string 24 prior to extending telescoping assembly 112 into secondary wellbore 56*a*. For other applications, well packer 94 may remain in its running or unset position until after piston assembly 112 indicates that elongated slot 106 is satisfactorily aligned with window 32. When self-locating assembly 90 is satisfactorily installed at the desired downhole location, running tool 92 and telescoping assembly 112 may be removed from primary wellbore 20. A production tubing string (not expressly shown) may then be inserted from the well surface and engaged with well packer 94. Various types of well completion equipment and tools may be included as part of the production tubing string.

Various types of well servicing operations may be performed in secondary wellbore 56*a* with the aid of self-locating assembly 90. For example, a coiled tubing string (not expressly shown) may be inserted through the production tubing string and longitudinal bore 98 extending through well packer 94. When the coiled tubing string engages tapered surface 110 of tubing exit whipstock 108, the coiled tubing string and any well tools attached thereto will be deflected through window 32 into secondary wellbore 56*a*. Various types of well tools may be attached to the coiled tubing string for use in acidizing, production testing, or production logging of secondary wellbore 56*a*. Also, a coiled tubing string may be inserted through longitudinal bore 98, elongated slot 106 and window 32 to install various types of downhole flow control devices such as a plug or choke within secondary wellbore 56*a*. Depending upon the characteristics of primary wellbore 20 and secondary wellbore 50*a*, wireline tools may also be inserted through longitudinal bore 98, elongated slot 106 and window 32. When well servicing of secondary wellbore 56*a* has been completed, coiled tubing and/or wire line tools may be inserted from the well surface to remove tubing exit whipstock 108 from longitudinal bore 98.

FIG. 7 is a schematic drawing showing self-locating reentry assembly 140 disposed within longitudinal bore 26 of casing window 24 adjacent to window 32. For the embodiment of the present invention as shown in FIG. 7, secondary wellbore 50 with liner 54 disposed therein extends from window 32. Self-locating reentry assembly 140 includes landing nipple 142 and previously described window assembly 96. Threaded connection 144 is used to engage landing nipple 142 with first end 101 of elongated housing 100. A tubing string such as drill pipe (not expressly shown), a workover string (not expressly shown) or a production tubing string (not expressly shown) may be attached to landing nipple 142 opposite from threaded connection 144. As discussed later in more detail, various types of well completion tools and downhole equipment may be attached to the tubing string above landing nipple 142 and/or below self-locating reentry assembly 140. The tubing string attached to landing nipple 142 may be used to move self-locating reentry assembly 140 from the well surface to a desired location with in longitudinal wellbore 26.

During movement of self-locating reentry assembly 140 from the well surface to a desired downhole location within longitudinal bore 26, locator key or lug 180 is preferably retained in its first position as shown in FIGS. 8 through 11.

As discussed later in more detail, retaining mechanism 202 may be activated to release locator lug or key 180 from its first, retracted position when self-locating reentry assembly 140 is at a desired downhole location.

Self-locating reentry assembly 140 may be used to reenter any number of secondary wellbores extending from primary wellbore 20 to perform completion, workover, and/or production operations within the respective secondary wellbore. For example, tubing exit whipstock 108 may be installed within longitudinal bore 98 or other devices satisfactory for use in directing well tools and small diameter tubing strings from longitudinal bore 98 into secondary wellbore 56. Self-locating reentry assembly 140 may also serve as a production control system to temporarily shut off fluid flow from an associated secondary wellbore while conducting production testing or stimulation of other secondary wellbores extending from primary wellbore 20. Self-locating reentry assembly 140 may also be used to provide long term control of production fluid flow by installing an isolation sleeve (not expressly shown) within longitudinal bore 98. The isolation sleeve may contain one or more flow chokes (not expressly shown) to balance production fluid flow from the associated secondary wellbore with production fluid flow from other formations communicating with primary wellbore 20. See FIGS. 15A and 15B.

For the embodiment of the present invention as shown in FIGS. 8 through 13, first end 187 of locator lug or key 180 is preferably rotatably secured within a portion of recess 178. Retaining mechanism 202 is preferably engaged with second end 188 to releasably hold locator lug or key 180 in its first, retracted position. The dimensions and configuration of both locator lug or key 180 and retaining mechanism 202 are selected to be compatible with recess 178 formed in the exterior of elongated housing 100.

For the embodiment of the present invention as shown in FIGS. 8 through 13, retaining mechanism 202 preferably includes cylinder or air chamber 204 with piston assembly 206 slidably disposed therein. Inside diameter 208 of cylinder 204 is preferably sized to slidably receive piston assembly 206. End 210 of cylinder 204 is preferably closed to form a fluid tight barrier with respect to the exterior of cylinder 204. For the embodiment of the present invention as shown in FIGS. 8 through 13, variable volume fluid chamber 216 may also be referred to as an "atmospheric chamber".

Figure 11:
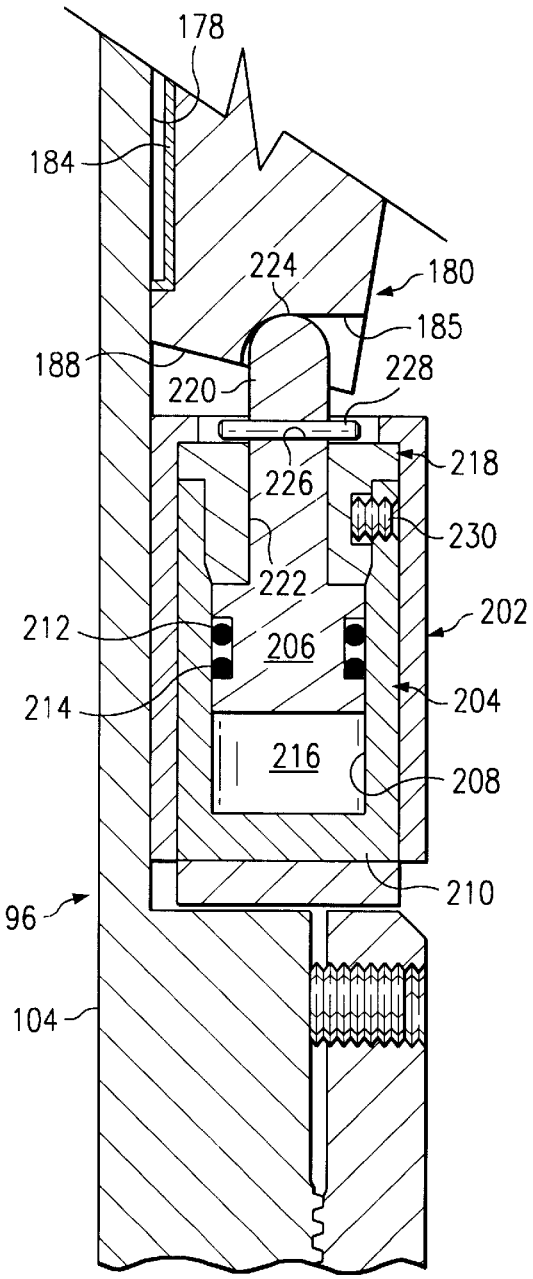
FIG. 11 is an enlarged schematic drawing in section with portions broken away showing the hydrostatic release mechanism of FIG. 8 in its first, extended position to hold the key or lug in its first, retracted position.
Figure 12:
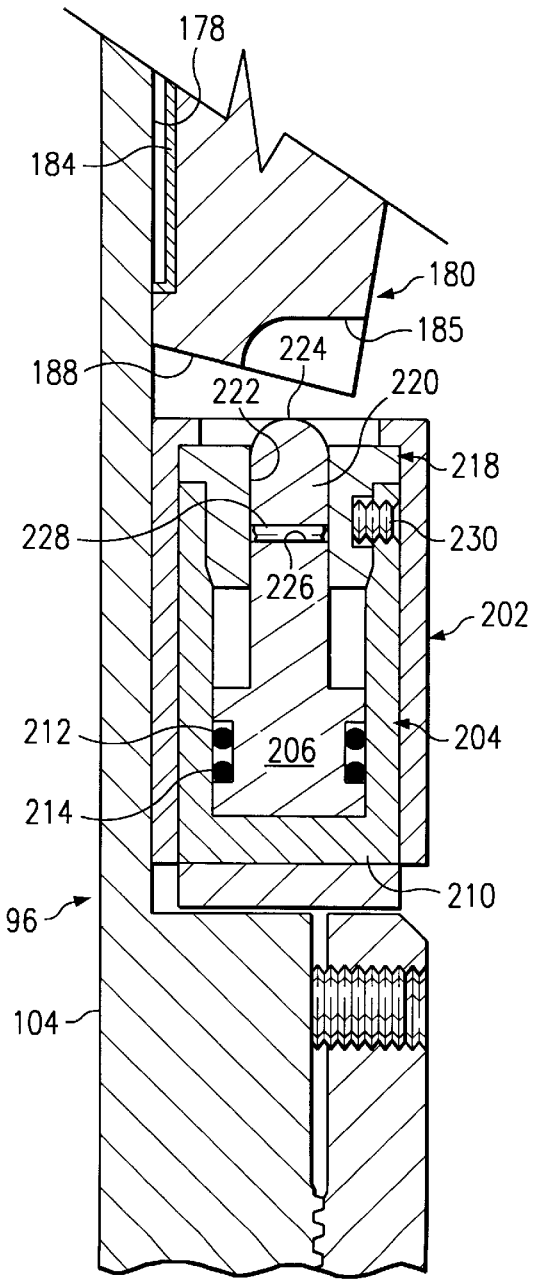
FIG. 12 is a schematic drawing in section with portions broken away showing the hydrostatic release mechanism of FIG. 8 in its second, retracted position which allows movement of the self-locating key radially outward.

For the embodiment of the present invention as best shown in FIGS. 11 and 12, elastomeric rings 212 and 214 are preferably disposed on the exterior of piston assembly 206 to form a movable fluid barrier with adjacent portions of inside diameter 208. Piston assembly 206, elastomeric rings 212 and 214, adjacent portions of inside diameter 208 and end 210 of cylinder 204 cooperate with each other to form variable volume fluid chamber 216. End cap or end closure 218 is preferably disposed within and attached to the end of cylinder 204 opposite from end 210. Piston assembly 206 preferably includes rod 220 which extends through opening 222 formed in end cap 218. Set screw 230 may be used to releasably secure end cap 218 with cylinder 204.

As best shown in FIGS. 11 and 12, end 224 of rod 220 opposite from piston assembly 206 is preferably sized to be received within recess or groove 182 formed in end 188 of locator lug or key 180 disposed adjacent thereto. Opening 226 is preferably formed in and extends generally laterally through rod 220 intermediate end 224 and piston assembly 206. Opening 226 is preferably sized to receive shear pin 228 therein. The length of shear pin 228 is preferably selected such that when shear pin 228 is disposed within opening 226, portions of shear pin 228 will extend from opposite sides of rod 220.

Retaining mechanism 220 has a first position such as shown in FIG. 11 in which end 224 of rod 220 engages recess 182 to hold locator lug or key 180 in its first, retracted position. Retaining mechanism 220 also has a second position as shown in FIG. 12 in which end 224 of rod 220 no longer extends a sufficient distance from end cap 218 to engage recess 182. Locator key or lug 180 and retaining mechanism 202 are preferably assembled at the well surface in their respective first positions as shown in FIGS. 8, 9, 10 and 11.

When retaining mechanism 202 is assembled at the well surface, air at atmospheric pressure will normally be trapped within variable volume fluid chamber 216. Locator key or lug 180 is preferably held in its first, retracted position. Shear pin 228 is preferably inserted through opening 226. Shear pin 228 and end cap 218 cooperate with each other to releasably secure piston assembly 206 and rod 220 in their first position as shown in FIGS. 8, 9, 10 and 11.

Figure 13:
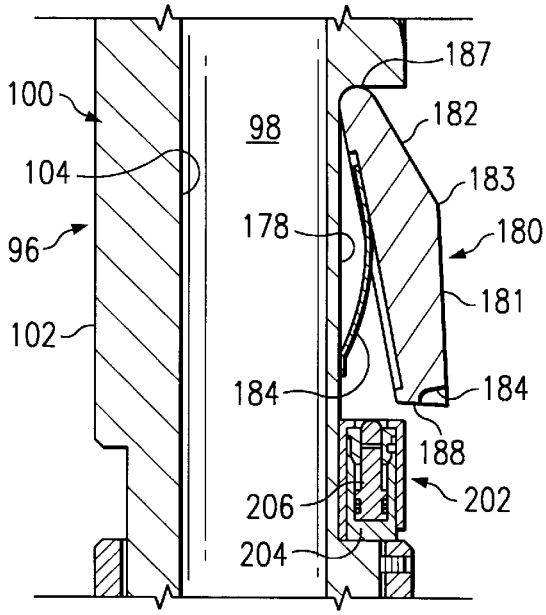
FIG. 13 is a schematic drawing in section and in elevation with portions broken away showing the self-locating key of FIG. 8 in its extended position.

Leaf spring or bow spring 184 is preferably disposed between the interior surface of locator lug or key 180 and the adjacent surface of recess 178. Leaf spring or bow spring 184 provides means for biasing locator lug or key 180 to move from its first, retracted position to its extended position as shown in FIGS. 7 and 13. Rod 220, recess 182 and cylinder 204 cooperate with each other to hold spring 184 in its compressed position as shown in FIG. 11. Other types of biasing means such as a hydraulic cylinder and piston or a bellows may be used as an alternative to spring 184.

Primary wellbore 20 and secondary wellbore 50 will often be filled with various types of well fluids such as drilling mud, well completion fluid, or production fluids from one or more adjacent hydrocarbon producing formations. These fluids will often be in a liquid state or phase. As a result, the hydrostatic pressure of the well fluids applied to the exterior of housing 100 will generally increase as self-locating reentry assembly 140 moves from the well surface to a downhole location proximate secondary wellbore 50. Also, the dimensions associated within the end cap 218, rod 220 and adjacent portions of cylinder 204 are selected such that any fluid pressure present on the exterior of housing 100 will be applied to piston assembly 206 opposite from variable volume chamber 216.

As hydrostatic fluid pressure within primary wellbore 20 increases, additional force will be applied to piston assembly 206 opposite from variable volume chamber 216. Engagement of shear pin 228 with rod 220 and end cap 218 will prevent movement of piston assembly 206 until hydrostatic pressure of the well fluids applies sufficient force on piston assembly 206 to shear both ends of pin 228 and compress the air contained within variable volume fluid chamber 216. When the force from hydrostatic pressure of well fluids on the exterior of housing 100 exceeds the associated shear limits, shear pin 226 will part and piston assembly 206 with rod 220 attached thereto will move to its second position as shown in FIG. 12.

Various types of shear mechanisms and/or frangible mechanisms may be satisfactorily used to releasably secure piston assembly 206 and rod 220 in their position as shown in FIG. 11. Examples of such other devices include shear discs, shear bolts, shear washers, and rupture discs. Locator lugs or keys and retaining mechanisms incorporating teachings of the present invention are not limited to use with shear pin 228. As previously noted, spring 184 biases locator lug or key 180 to move radially outward from recess 178. If self-locating reentry assembly 140 is disposed adjacent to and properly aligned with window 32, locator key or lug 180 may move outward to its extended position as shown in FIGS. 7 and 13.

Figure 8:
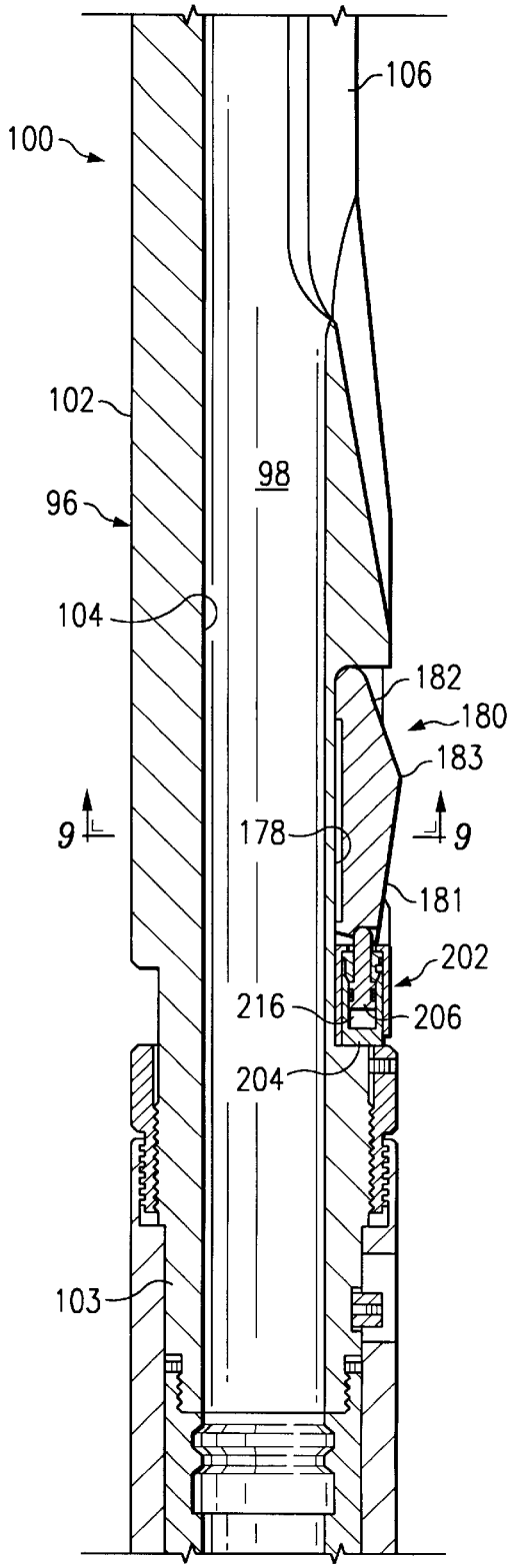
FIG. 8 is a schematic drawing in section with portions broken away showing a self-locating window assembly having a lug or key in a first, retracted position and a hydrostatic releasing mechanism incorporating teachings of the present invention.
Figure 9:
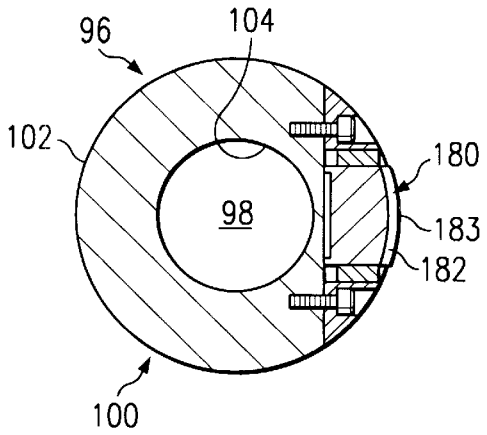
FIG. 9 is a schematic drawing in section taken along lines 9—9 of FIG. 8.

For the embodiment of the present invention as shown in FIGS. 7 through 13, locator lug or key 180 has an exterior surface defined in part by first tapered surface 181 and second tapered surface 182. Knuckle or ridge 183 is preferably formed on the exterior of locator key or lug 180 between first tapered surface 181 and second tapered surface 182. The dimensions of locator key or lug 180, recess 178 and knuckle 183 are preferably selected such that when locator key 180 is in its first position as shown in FIGS. 8 and 9, knuckle or ridge 183 will not extend from housing 100 a sufficient distance to contact inside diameter 28 of casing string 24.

Figure 10:
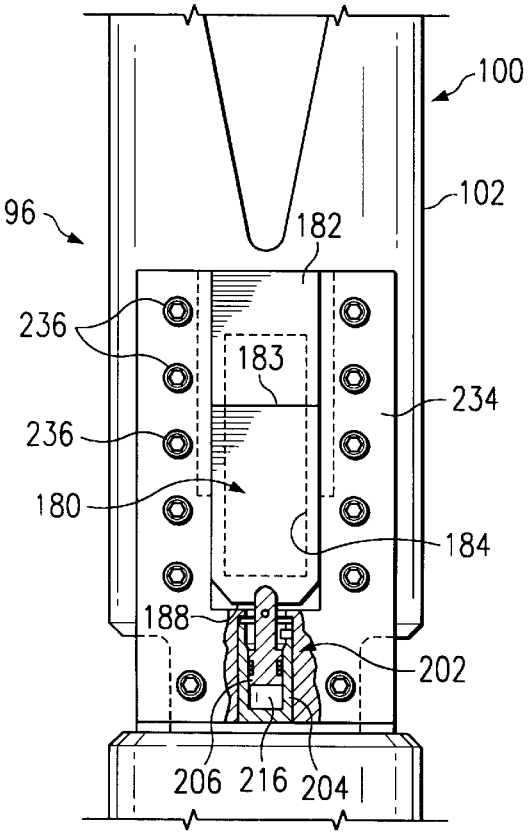
FIG. 10 is a schematic drawing in elevation with portions broken away showing a side view of the locator key and hydrostatic release mechanism of FIG. 8.

As best shown in FIGS. 9, 10 and 13, locator lug or key 180 has generally rectangular cross-sections along its length, width and thickness, except for previously described exterior surfaces 181, 182, and ridge 183. Coverplate 234 and a plurality of bolts 236 may be used to mount locator lug or key 180 and retaining mechanism 202 on the exterior of housing 100. The exterior of locator key or lug 180 may have various configurations other than tapered surfaces 181 and 182 with ridge or knuckle 183 disposed therebetween. For example, the exterior surface of locator lug or key 180 may include a beveled surface (not expressly shown) having a radius which corresponds approximately with the radius of liner 54 to minimize any interference between movement of well tools and small diameter tubing strings between longitudinal bore 98 and longitudinal bore 56. The exterior surface of a locator lug or key incorporating teachings of the present invention is preferably selected to minimize or eliminate any interference with movement of the associated well tool or assembly through a primary wellbore and communication of other well tools or small diameter tubing strings between the primary wellbore and a secondary wellbore.

Hydrostatic pressure present within primary wellbore 20 may result in piston assembly 206 and rod 220 moving to their second position before self-locating reentry assembly 140 is at the desired location relative to window 32. The dimensions and configuration of locator key or lug 180, knuckle 183 and tapered surface 181 are preferably selected such that if self-locating reentry assembly 140 is not disposed adjacent to and properly aligned with window 32 when retaining mechanism 202 releases locator lug or key 180, only knuckle 183 and/or tapered surface 181 will engage inside diameter 28 of casing string 24. The tubing string attached to self-locating reentry assembly 140 may be used to position locator key or lug 180 adjacent to window 32.

For some applications, self-locating reentry assembly 140 may be installed within a primary wellbore in which well fluid pressure on the exterior of housing 100 may be greater than normal hydrostatic pressure. For example, primary wellbore 20 and/or second wellbore 50 may be in fluid communication with a relatively high pressure hydrocarbon producing formation. Also, the specific gravity of well fluids contained within primary wellbore 20 may vary substantially between the well surface and window 32.

The size and type of shear pin 228 installed within opening 226 is preferably selected such that anticipated downhole fluid pressures will result in releasing piston assembly 206 and rod 220 from their first position at a downhole location below any restrictions within primary wellbore 24 that might inadvertently engage end 188 of locator lug or key 180 when it moves readily outward from recess 178. Shear pin 228 is also preferably selected to release piston assembly 206 and rod 220 at a downhole location above the selected window 32. Typical values of hydrostatic pressure for which both ends of a brass pin will be sheared when variable volume fluid chamber 216 is at atmospheric pressure are as follows:

| SHEAR PIN SIZE | PRESSURE |
|---|---|
| .062 | 800 psi |
| .090 | 1400 psi |
| .100 | 1800 psi |
| .125 | 2800 psi |

For some applications, cylinder 204 and/or piston assembly 206 may be modified to respond to changes in fluid pressure within longitudinal bore 98. This modification may be particularly beneficial for those applications in which the fluid pressure within longitudinal bore 98 of self-locating reentry assembly 140 is not the same as fluid pressure within longitudinal bore 26 adjacent to the exterior of self-locating reentry assembly 140. Modifying cylinder 204 and/or piston assembly 206 to respond to fluid pressure within longitudinal bore 98 may sometimes be desirable to allow more precise control of the location within primary wellbore 20 at which retaining mechanism 202 will release locator lug or key 180. For example, the desired window 32 for engagement by locator lug or key 180 may be located in a substantially horizontal portion of primary wellbore 20 having approximately the same hydrostatic pressure extending therethrough. For still other applications, cylinder 204 and/or piston assembly 206 may be modified to respond to a combination of hydrostatic pressure and fluid pressure within longitudinal bore 98.

For some applications, a locator lug or key incorporating teachings of the present invention is preferably engaged with portions of window 32 adjacent to second end 40 or portions of opening 62 of liner 54 adjacent to second end 70. As previously noted, the dimensions of a locator lug or key may be selected in accordance with teachings of the present invention to match selected portions of a lateral opening such as window 32 and/or opening 62 formed on the end of liner 54. For some applications such as shown in FIG. 14, it may be preferable to provide a self-locating assembly with locator lug or key 280 having a cross-section and exterior configuration selected to correspond generally with first end 34 of window 32. The dimensions and configuration of locator lug or key 280 may be selected such that as the associated self-locating assembly moves from the well surface to a desired downhole location, inside diameter 28 of casing string 24 may bias locator lug or key 128 radially inward. For this embodiment of the present invention, locator lug or key 280 may move radially outward when the associated self-locating assembly is disposed adjacent to and aligned with window 32. The exterior surface (not expressly shown) with locator lug or key 280 is preferably selected to allow downward movement through any restrictions present in equipment located at the well surface or any restrictions within primary wellbore 20 prior to the selected window 32.

Multilateral well completions often include more than one secondary wellbore extending from a primary wellbore. Also, multilateral well completions often receive production fluid from two or more different hydrocarbon producing formations. Therefore, it is sometimes desirable to isolate a secondary wellbore from other portions of an associated primary wellbore and/or other secondary wellbores extending from the same primary wellbore. One of the technical benefits of the present invention includes the ability to form multiple fluid barriers within a primary wellbore to isolate a secondary wellbore extending therefrom and to provide optimum location and alignment for communicating well tools and small diameter tubing strings through a lateral opening in the primary wellbore.

Figure 15A:
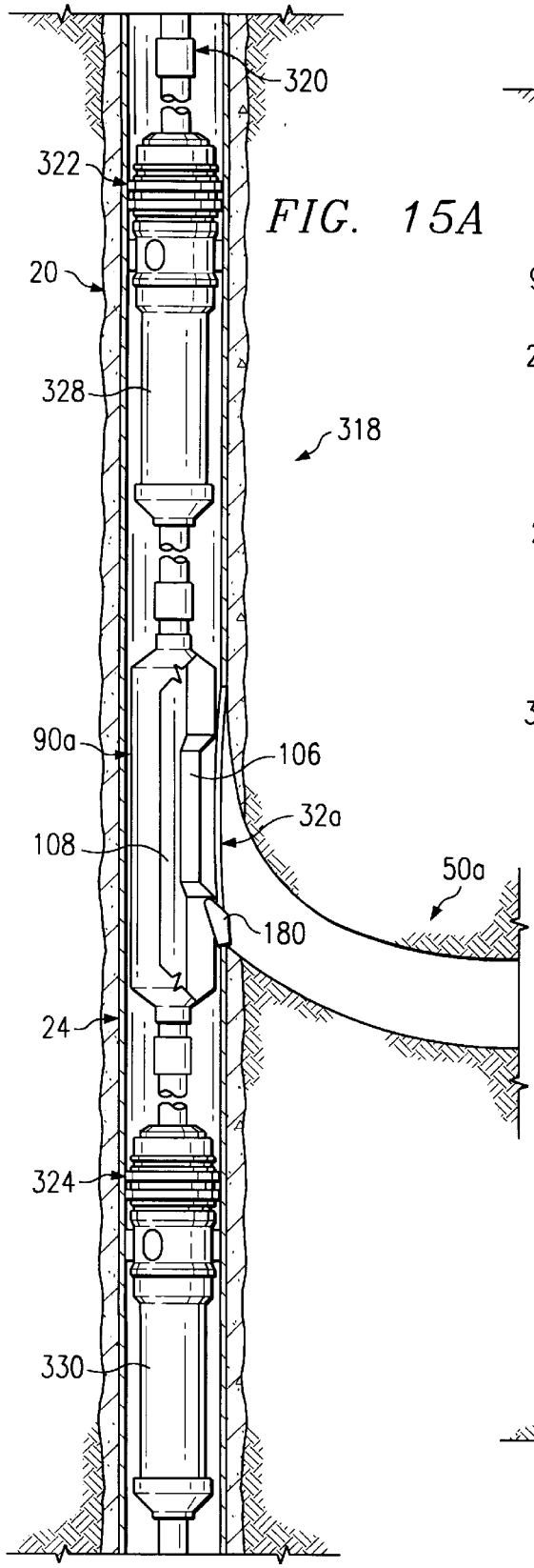
FIG. 15A is a schematic drawing in section and in elevation with portions broken away showing an example of a multilateral well completion with a reentry system incorporating teachings of the present invention disposed adjacent to and aligned with a window formed in a primary wellbore.
Figure 15B:
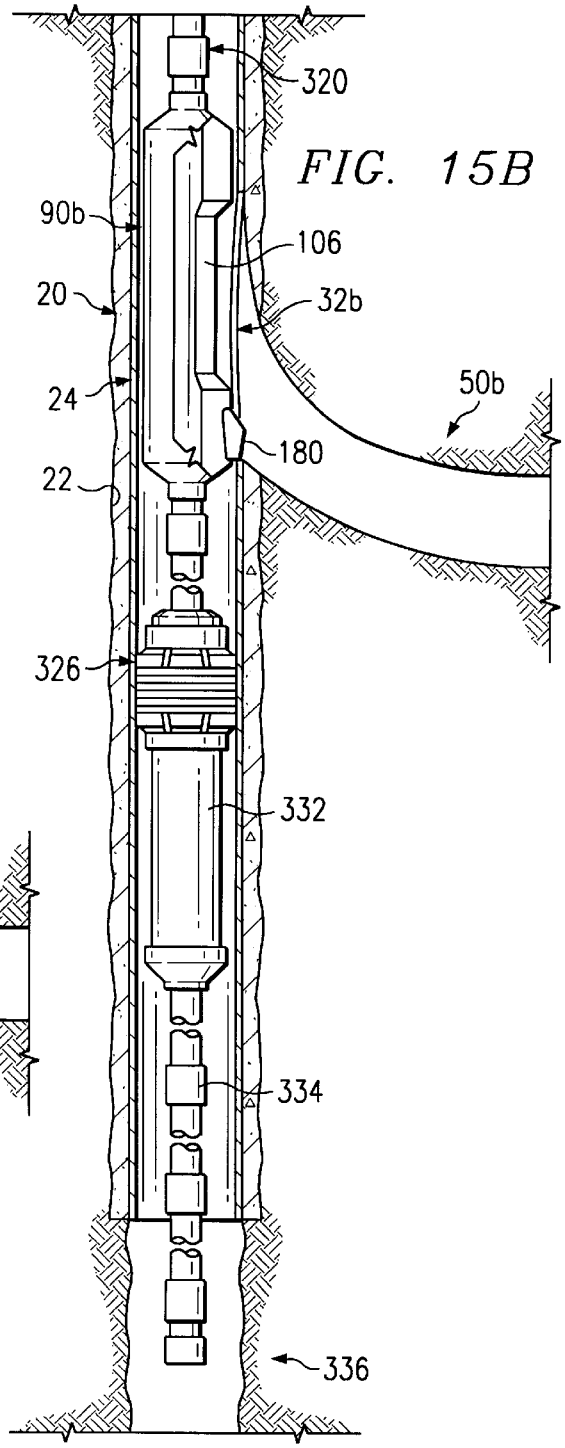
FIG. 15B is a schematic drawing in section and in elevation with portions broken away showing further components of the multilateral well completion of FIG. 15A.

Multilateral well completion 318 incorporating teachings of the present invention is shown in FIGS. 15A and 15B, which will be collectively referred to as FIG. 15. Multilateral well completion 318 includes primary wellbore 20 and secondary wellbore 50*a* as previously described for well completion 18*a*. Multilateral well completion 318 also includes secondary wellbore 50*b* which may be substantially the same as previously described secondary wellbore 50*a* except secondary wellbore 50*b* may be directed to a different "target" or hydrocarbon-producing formation as compared to secondary wellbore 50*a*.

Primary wellbore 20 preferably includes casing string 24 as previously described for well completions 18 and 18*a* along with first window 32*a* and second window 32*b* formed therein. Windows 32*a* and 32*b* are substantially the same as previously described window 32. Secondary wellbores 50*a* and 50*b* extend from respective windows 32*a* and 32*b*. For the embodiment of the present invention as shown in FIG. 15, secondary wellbores 50*a* and 50*b* are shown as "open hole" completions. However, liner 54 may be installed in either or both secondary wellbores 50*a* and 50*b* as desired.

For the embodiment of the present invention as shown in FIG. 15 production tubing string 320 extends from the well surface and is disposed within casing string 24. Production tubing string 320 preferably includes self-locating assemblies 90*a* and 90*b* which are preferably disposed adjacent to and aligned with respective windows 32*a* and 32*b* in accordance with teachings of the present invention. Production tubing string 320 also includes retrievable seal bore packers 322, 324 and 326. For the embodiment of the present invention as shown in FIG. 15, retrievable seal bore packers 322, 324 and 326 include respective seal bore extensions 328, 330 and 332. Production tubing string 320 also includes tailpipe 334 which is preferably attached to seal bore extension 332 to receive production fluids from hydrocarbon-producing formation 336. Production fluids from respective hydrocarbon-producing formations (not expressly shown) may flow into primary wellbore 20 from secondary wellbore 50*a*, secondary wellbore 50*b*, and hydrocarbon-producing formation 336 adjacent to tailpipe 334.

Retrievable seal bore packer 322 is preferably disposed within casing string 24 above window 32*a* and self-locating assembly 90*a*. Retrievable seal bore packer 324 is preferably disposed within casing string 24 between windows 32*a* and 32*b*. Self-locating assembly 90*a* is preferably attached to production tubing string 320 below seal bore extension 330 adjacent to and aligned with window 32*b* in accordance with teachings of the present invention. Retrievable seal bore packer 326 is preferably disposed within casing string 24 below window 32*b* and self-locating assembly 90*b*.

Retrievable seal bore packers 322 and 324 cooperate with each other to direct production fluid flow from secondary wellbore 50*a* into slot 106 formed in the exterior of self-locating assembly 90*a*. Retrievable seal bore packers 322 and 324 prevent communication of well fluids contained within secondary wellbore 50*a* with other portions of primary wellbore 20. Retrievable seal bore packers 324 and 326 provide similar fluid flow control and isolation with respect to secondary wellbore 50*b*.

The distance between retrievable seal bore packers 322, 324, 326, their associated seal bore extensions 328, 330, 332 and respective windows 32*a* and 32*b* are preferably known to allow satisfactory installation of production tubing string 320 within primary wellbore 20. Self-locating assemblies 90*a* and 90*b* preferably include locator lug or key 180 which will accommodate any variation between the anticipated and actual location and orientation of respective windows 32*a* and 32*b*. The distance between windows 32*a* and 32*b* and the anticipated location for installation of retrievable seal bore packers 322. 324 and 326 are preferably generally known prior to installation of production tubing string 320. However, self-locating assemblies 90*a* and 90*b* include locator lug or key 180.

Various types of well tools such as tubing exit whipstock 108 may be disposed within longitudinal bore 98 extending through self-locating assemblies 90*a* and/or 90*b*. Also, an isolation tube (not expressly shown) may be installed within longitudinal bore 98 extending through self-locating assembly 90*a* and/or 90*b*. A well plug may be installed within appropriate portions of production tubing string 320 to allow production testing of respective secondary well bores 50*a* and 50*b*, or production testing of hydrocarbon producing formation 336. For example, respective isolation tubes may be installed within self-locating assembly 90*a* and self-locating assembly 90*b*. With this configuration, production testing and/or well servicing of hydrocarbon producing formation 336 may be conducted. Alternatively, a well plug could be installed within the portion of production tubing string 320 between self-locating assembly 90*a* and self-locating assembly 90*b* such that production testing and/or well servicing could be conducted on secondary wellbore 50*a*.

Locator lugs or key 180 provide positive location and orientation of the respective self-locating assemblies 90*a* and 90*b* such that retrievable seal bore packers 322, 324 and 326 may be set at the desired location to isolate respective secondary wellbores 50*a* and 50*b*. While at the same time ensuring optimum location and alignment with the respective window 32*a* and 32*b*. Multilateral well completion 318 as shown in FIG. 15 is only one example of a packer system which may be used in accordance with teachings of the present invention to provide fluid isolation with respect to secondary wellbore 50*a* and secondary wellbore 50*b*.

Figure 16:
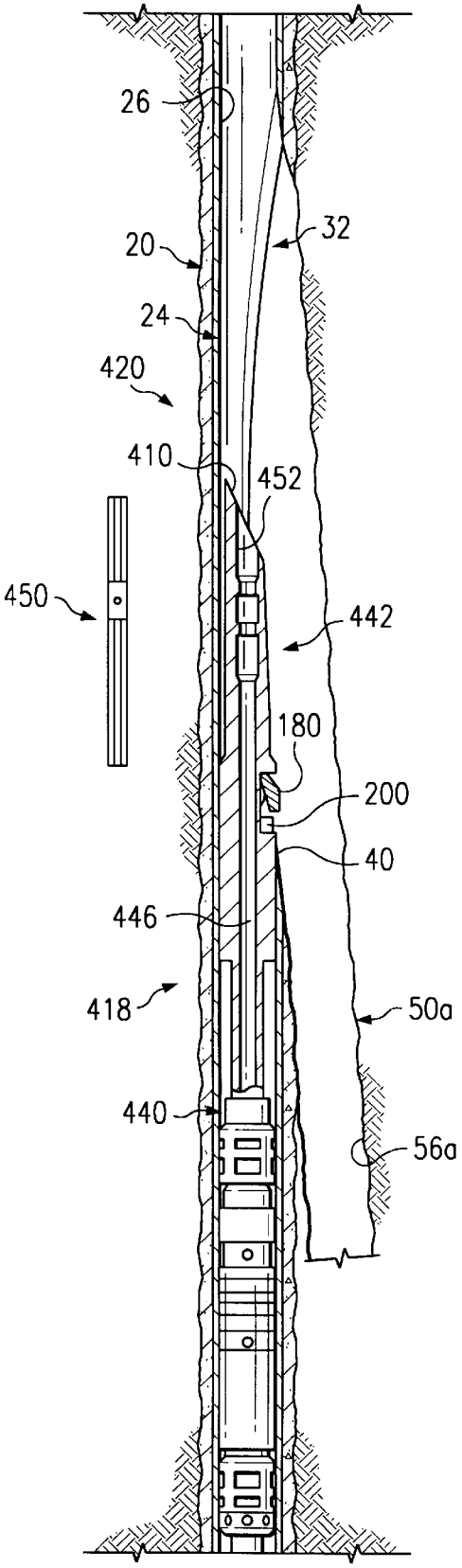
FIG. 16 is a schematic drawing in section and in elevation with portions broken away showing another example of a multilateral well completion with a reentry system incorporating teachings of the present invention disposed adjacent to and aligned with a window formed in a primary wellbore.
Figure 17:
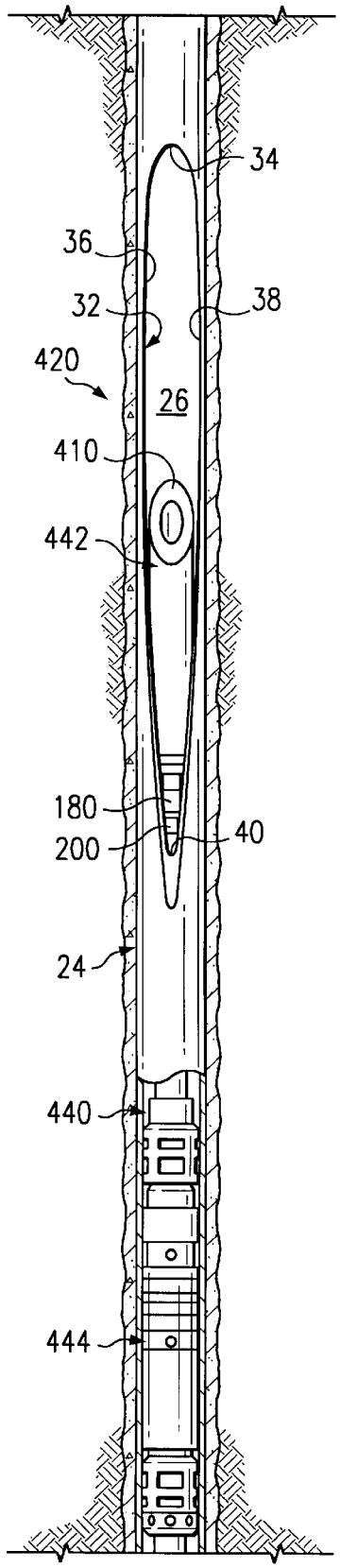
FIG. 17 is a schematic drawing in section and in elevation with portions broken away showing another view of the reentry system of FIG. 16.

Multilateral well completion 418 incorporating teachings of the present invention is shown in FIGS. 16 and 17. Multilateral well completion 418 includes primary wellbore 20 and secondary wellbore 50*a* as previously described with respect to well completion 18*a*. Primary wellbore 20 preferably includes casing string 24 with window 32 formed therein. Secondary wellbore 50*a* extends from window 32.

Self-locating reentry assembly 440 as shown in FIGS. 16 and 17 preferably includes whipstock assembly 442 and well packer 444. For the embodiment of the present invention as shown in FIGS. 16 and 17 well packer 444 may be a hydraulically set, retrievable well packer. Longitudinal bore 446 preferably extends through whipstock assembly 442 and attached well packer 444. Self-locating assembly 440 may be used to install whipstock assembly 410 at the optimum location adjacent to window 32 for a wide variety of well servicing operations such as redrilling secondary wellbore 50*a* in the event of a collapse within a portion of longitudinal bore 56*a*.

Locator lug or key 180 and releasing mechanism 200 are preferably installed in the exterior of whipstock assembly 446. Locator lug or key 180 is preferably aligned with tapered surface 410 of whipstock assembly 442. Running tool 450 may be engaged with profile 452 formed on the interior of longitudinal bore 446 within whipstock assembly 442. For some applications, running tool 450 may be used to lower self-locating assembly 440 to a desired location within primary wellbore 20.

Hydrostatic pressure within wellbore 20 may be used to activate releasing mechanism 200 and releasing locator key or lug 180 from its first, retracted position. Alternatively, releasing mechanism 200 may include an electrical or mechanical timer or may be activated by electromagnetic or sonic signals from the well surface.

After releasing locator lug or key 180 from its first, retracted position, running tool 450 may be used to position self-locating assembly 440 at a location corresponding generally with the anticipated location of window 32. Running tool 450 may then be used to rotate self-locating assembly 440 until locator key 180 engages tapered sides 36 and 38 of window 32. Running tool 450 may then be used to raise and lower self-locating assembly 440 to confirm that locator lug or key 180 is properly engaged with window 32 at the optimum location for tapered surface 410 to communicate well tools from longitudinal bore 26 into longitudinal bore 56*a* of secondary wellbore 50*a*. When locator lug or key 180 is in the desired position within window 32, well packer 444 may be hydraulically set within casing string 24.

When well servicing operations in secondary wellbore 50*a* have been completed, a pulling tool (not expressly shown), may be engaged with whipstock assembly 42 and released from well packer 44. Since locator lug or key 180 is rotatably engaged with the associated recess 178, locator lug or key 180 will be compressed radially inward by any restrictions within primary wellbore 20. Thus, locator lug or key 180 will not interfere with removal of whipstock assembly 442 from primary wellbore 20. Depending upon various factors, well packer 44 may also be removed with whipstock assembly 442 or may remain within primary wellbore 20.

Various mechanisms may be satisfactory used to attach locator lug or key 180 with housing assembly 100 to allow movement of locator lug or key 180 from its first retracted position to a second, expanded position. One example of such mechanisms is shown in FIGS. 18, 19 and 20. First end 187 of locator lug or key 180 preferably has a generally curved exterior surface to accommodate pivoting or rotational movement of locator lug or key 180 relative to housing assembly 100. For the embodiment of the present invention as shown in FIGS. 18, 19 and 20, cover plate 234 preferably includes a pair of brackets 238 and 240 disposed on opposite sides of locator lug or key 180. Brackets 238 and 240 include respective void spaces 242 and 244. Locator lug or key 180 preferably includes respective limit ridges or shoulders 248 and 250 extending from opposite sides thereof. Each limit ridge or shoulder 248 and 250 preferably includes a respective tapered surface 252. The dimensions associated with limit ridges or shoulders 248 and 250 and respective tapered surfaces 252 are selected to be compatible with respective brackets 238 and 240 as best shown in FIGS. 18, 19 and 20.

The dimensions and configuration of brackets 238 and 240, and the dimensions associated with limit ridges 248 and 250 are selected such that tapered surfaces 252 will contact respective brackets 238 and 240 as locator lug or key 180 moves from its first position as shown in FIG. 19 to its second position as shown in FIG. 20.

Various types of pivot pins, bearing assemblies and other pivot mechanisms may be satisfactory used to engage a locator lug or key with a housing in accordance with teachings of the present invention. A self-locating assembly incorporating teachings of the present invention is not limited to use with brackets 234 and 240 in combination with limit ridges or shoulders 248 and 250 as shown in FIGS. 18, 29 and 20.

Although the present invention and its advantages have been described in detail, it should be understood that various changes, substitutions, and alterations may be made therein without departing from the spirit and the scope of the invention as defined by the following claims.

What is claimed is:

1. A self-locating assembly for use in a well completion having a first wellbore and a second wellbore communicating with the first wellbore through a lateral opening in the first wellbore, comprising:

a housing having an exterior selected to be compatible with movement through the first wellbore, and a longitudinal bore;

a lug carried by the housing for receipt in and engagement with the lateral opening to locate and align the self-locating assembly therewith in a single predetermined rotational orientation relative thereto; and an exit slot formed in a portion of the housing to allow communication between the longitudinal bore and the exterior of the housing.

2. A self-locating assembly for use in a well completion having a first wellbore and a second wellbore communicating with the first wellbore through a lateral opening formed in the first wellbore, comprising:

a housing assembly having a longitudinal bore extending therethrough;

the housing assembly having exterior dimensions selected to be compatible with movement of the housing assembly through the first wellbore;

a lug carried by the housing assembly;

the lug having a retracted position to minimize interference with movement of the housing assembly through the first wellbore;

the lug having an extended position whereby the lug may enter and be engaged with the lateral opening to locate and align the self-locating assembly in a single predetermined rotational orientation relative thereto; and an exit slot formed in a portion of the housing assembly to allow communication between the longitudinal bore and the exterior of the housing assembly.

3. The self-locating assembly of claim 2, further comprising:

the lug aligned with the exit slot whereby engagement of the lug with the lateral opening will align the exit slot with the lateral opening to allow communication between the longitudinal bore and the second wellbore; and a piston assembly to releasably secure the lug in its retracted position and to allow movement of the lug to its extended position when a selected amount of fluid pressure is applied to the piston assembly.

4. The self-locating assembly of claim 3, wherein the piston assembly allows the lug to move from its retracted position to its extended position in response to a selected amount of hydrostatic pressure in the first wellbore.

5. The self-locating assembly of claim 3, wherein the piston assembly allows the lug to move from its retracted position to its extended position in response to hydraulic pressure.

6. The self-locating assembly of claim 2, further comprising the lug disposed in a recess in the housing assembly and a biasing means disposed in the recess to move the lug from its retracted position to its extended position.

7. The self-locating assembly of claim 2, further comprising a whipstock.

8. A self-locating assembly for use in a well completion having a first wellbore and a second wellbore communicating with the first wellbore through a lateral opening formed in the first wellbore, comprising:

a housing assembly having a longitudinal bore extending therethrough, the housing assembly having exterior dimensions selected to be compatible with movement of the housing assembly through the first wellbore;

a lug carried by the housing assembly, the lug having a retracted position to minimize interference with movement of the housing assembly through the first wellbore, the lug having an extended position whereby the lug may enter and be engaged with the lateral opening to locate and align the self-locating assembly in a single predetermined rotational orientation relative thereto; and a tubing exit window assembly.

9. A self-locating assembly for use in a well completion having a first wellbore and a second wellbore communicating with the first wellbore through a lateral opening formed in the first wellbore, comprising:

a housing assembly having a longitudinal bore extending therethrough, the housing assembly having exterior dimensions selected to be compatible with movement of the housing assembly through the first wellbore;

a lug carried by the housing assembly, the lug having a retracted position to minimize interference with movement of the housing assembly through the first wellbore, the lug having an extended position whereby the lug may enter and be engaged with the lateral opening to locate and align the self-locating assembly in a single predetermined rotational orientation relative thereto; and a tubing exit window assembly with a tubing exit whipstock disposed therein.

10. A self-locating well tool for use in downhole well completions having a first wellbore and a second wellbore communicating with the first wellbore through a lateral opening formed in the first wellbore with the lateral opening having a first end defined by a first radius and a second end defined in part by first and second tapered surfaces which converge to form the second end of the lateral opening, the well tool comprising:

a housing having a longitudinal bore extending therethrough;

the housing having exterior dimensions selected to be compatible with movement Of the self-locating well tool through the first wellbore;

a lug disposed in the exterior of the housing;

the locator lug having a retracted position to minimize interference with movement Of the housing within the first wellbore;

the lug having an extended position whereby the lug may enter and be engaged with the lateral opening in the first wellbore; and a portion of the lug having a configuration corresponding generally with the second end of the lateral opening in the first wellbore whereby the lug may be engaged with the second end of the lateral opening to align the self-locating tool therewith.

11. The well tool of claim 10, wherein the lug further comprises an exterior surface having a configuration selected to engage the first and second tapered surfaces of the lateral opening in the first wellbore to align the self-locating well tool therewith.

12. A self-locating reentry assembly for use in a well completion having a first wellbore and a second wellbore communicating with the first wellbore through a lateral opening in the first wellbore, the reentry assembly comprising:

an elongated housing having a longitudinal bore extending therethrough and a landing nipple disposed in an upper portion of the housing assembly with a locking recess and a seal bore formed therein;

the elongated housing having exterior dimensions selected to be compatible with movement of the reentry assembly through the first wellbore;

a locator lug disposed in a recess formed in the exterior Of the elongated housing;

the locator lug having a retracted position to minimize interference with movement of the elongated housing within the first wellbore; and the locator lug having an extended position whereby the locator lug may enter and be engaged with the lateral opening in a manner aligning the elongated housing with the lateral opening in a single predetermined rotational orientation relative thereto.

13. A self-locating reentry assembly for use in a well completion having a first wellbore and a second wellbore communicating with the first wellbore through a lateral opening in the first wellbore, the reentry assembly comprising:

an elongated housing having a longitudinal bore extending therethrough;

the elongated housing having exterior dimensions selected to be compatible with movement of the reentry assembly through the first wellbore;

a locator lug disposed in a recess formed in the exterior of the elongated housing;

the locator lug having a retracted position to minimize interference with movement of the elongated housing within the first wellbore;

the locator lug having an extended position whereby the locator lug may enter and be engaged with the lateral opening in a manner aligning the elongated housing with the lateral opening in a single predetermined rotational orientation relative thereto; and a biasing structure disposed in the recess to bias the locator lug to move from its retracted position to an extended position.

14. A self-locating reentry assembly for use in a well completion having a first wellbore and a second wellbore communicating with the first wellbore through a lateral opening in the first wellbore, the reentry assembly comprising:

an elongated housing having a longitudinal bore extending therethrough;

the elongated housing having exterior dimensions selected to be compatible with movement of the reentry assembly through the first wellbore;

a locator lug disposed in a recess formed in the exterior of the elongated housing;

the locator lug having a retracted position to minimize interference with movement of the elongated housing within the first wellbore;

the locator lug having an extended position whereby the locator lug may enter and be engaged with the lateral opening in a manner aligning the elongated housing with the lateral opening in a single predetermined rotational orientation relative thereto; and a piston assembly to allow the locator lug to move from its retracted position to its extended position in response to a selected amount of hydrostatic pressure in the first wellbore.

15. A self-locating reentry assembly for use in a well completion having a first wellbore and a second wellbore communicating with the first wellbore through a lateral opening in the first wellbore, the reentry assembly comprising:

an elongated housing having a longitudinal bore extending therethrough;

the elongated housing having exterior dimensions selected to be compatible with movement of the reentry assembly through the first wellbore;

a locator lug disposed in a recess formed in the exterior of the elongated housing;

the locator lug having a retracted position to minimize interference with movement of the elongated housing within the first wellbore;

the locator lug having an extended position whereby the locator lug may enter and be engaged with the lateral opening in a manner aligning the elongated housing with the lateral opening in a single predetermined rotational orientation relative thereto; and a piston assembly to allow the locator lug to move from its retracted position to its extended position in response to hydraulic pressure applied to the piston assembly.

16. A self-locating reentry assembly for use in a well completion having a first wellbore and a second wellbore communicating with the first wellbore through a lateral opening in the first wellbore, the reentry assembly comprising:

an elongated housing having a longitudinal bore extending therethrough;

the elongated housing having exterior dimensions selected to be compatible with movement of the reentry assembly through the first wellbore; and a locator lug disposed in a recess formed in the exterior of the elongated housing;

the locator lug having a retracted position to minimize interference with movement of the elongated housing within the first wellbore;

the locator lug having an extended position whereby the locator lug may enter and be engaged with the lateral opening in a manner aligning the elongated housing with the lateral opening in a single predetermined rotational orientation relative thereto, the locator lug comprising an exterior surface and an interior surface with one end Of the lug extending therebetween; the exterior surface having a first tapered portion and a second tapered portion; and a knuckle formed between the first tapered portion and the second tapered portion whereby the knuckle will not extend from the recess when the locator lug is in its first position and the knuckle will extend from the recess when the piston assembly releases the locator lug.

17. A self-locating reentry assembly for use in a well completion having a first wellbore and a second wellbore communicating with the first wellbore through a lateral opening in the first wellbore, the reentry assembly comprising:

an elongated housing having a longitudinal bore extending therethrough;

the elongated housing having exterior dimensions selected to be compatible with movement of the reentry assembly through the first wellbore;

a locator lug disposed in a recess formed in the exterior of the elongated housing;

the locator lug having a retracted position to minimize interference with movement of the elongated housing within the first wellbore;

the locator lug having an extended position whereby the locator lug may enter and be engaged with the lateral opening in a manner aligning the elongated housing with the lateral opening in a single predetermined rotational orientation relative thereto;

the elongated housing having a first end and a second end;

a running tool connected with the first end of the elongated housing;

a longitudinal bore extending through the running tool and the elongated housing;

the elongated housing having a generally cylindrical configuration with an elongated slot extending generally laterally through the housing intermediate the first end and the second end;

a tubing exit whipstock disposed within the longitudinal bore proximate the second end of the elongated housing and having a tapered surface;

a telescoping assembly slidably disposed within the longitudinal bore of the running tool and the elongated housing;

a piston assembly attached to one end of the telescoping assembly;

an elongated hollow tube extending from the piston assembly; and the telescoping assembly having a first position defined in part by the one end of the elongated hollow tube resting on the tapered surface of the tubing exit whipstock and the telescoping assembly having a second position defined in part by a portion of the elongated hollow tube extending through the elongated slot and into the second wellbore.

18. A self-locating reentry window assembly for use in downhole well completions having a first, generally vertical wellbore and a second wellbore extending generally laterally from a window formed in the first wellbore, the window assembly comprising:

an elongated housing assembly having a longitudinal bore extending therethrough;

a landing nipple disposed in an upper portion of the housing assembly with a locking recess and a seal bore formed therein;

an exit slot formed in a portion Of the housing assembly to allow communication between the longitudinal bore and the exterior of the housing assembly;

a locator lug disposed in a recess formed in the exterior of the housing assembly;

the locator lug having a retracted position and an extended position whereby the locator lug may be engaged with the window;

the locator lug aligned with the exit slot whereby engagement of the locator lug with the window will align the exit slot with the window to allow communication between the longitudinal bore and the second wellbore; and a piston assembly disposed in the elongated housing to releasably secure the locator lug in its retracted position and to allow movement of the locator lug toward its extended position when a selected amount of fluid pressure is applied to the piston assembly.

19. A method for locating a well tool assembly at a selected location in a first wellbore having a second wellbore extending from a lateral opening in the first wellbore, comprising:

installing a locator lug in the well tool assembly with the locator lug in a first, retracted position;

attaching the well tool assembly to a tubing string and positioning the well tool assembly at a location proximate the lateral opening in the first wellbore;

releasing the locator lug from its first position and allowing the locator lug to extend radially outward from the well tool assembly; and engaging the locator lug with the lateral opening to locate the well tool assembly at a desired location relative to the lateral opening and the second wellbore.

20. The method of claim 19, wherein the lateral opening includes a configuration defined in part by a first end and a second end with a pair of tapered surfaces extending from the first end to the second end comprising adjusting the thickness of the locator lug to vary the position at which the locator lug will engage the tapered surfaces relative to the second end of the lateral opening.

21. The method of claim 19, further comprising engaging the locator lug with a pair of tapered surfaces formed in the lateral opening to align the well tool assembly with the lateral opening.

22. The method of claim 19, further comprising engaging the locator lug with a first end of the lateral opening.

23. The method of claim 19, wherein the window includes a first end and a second end comprising engaging the locator lug with the second end of the lateral opening.

24. The method of claim 19 further comprising:

attaching the well tool assembly to a tubing string; and rotating the tubing string to position the locator lug within the lateral opening.

25. The method of claim 19, further comprising:

attaching the well tool assembly to a tubing string; and raising and lowering the well tool assembly with the tubing string to engage the locator lug at the desired location relative to the lateral opening.

26. The method of claim 19, further comprising engaging the locator lug with the window to align the well tool assembly with the lateral opening.

27. The method of claim 19, further comprising raising and lowering the well tool assembly to engage the lug at the desired location within the lateral opening.

28. The method of claim 19, further comprising:

installing a telescoping assembly within a longitudinal bore extending through the well tool assembly; and applying fluid pressure to the telescoping assembly to extend at least a portion of the telescoping assembly from the longitudinal bore through an exit in the well tool assembly and the lateral opening into the second wellbore.

* * * * *